US008161708B2

(12) United States Patent
Schacht et al.

(10) Patent No.: US 8,161,708 B2
(45) Date of Patent: Apr. 24, 2012

(54) FINISHING SET FOR A FLOOR COVERING AND HOLDER, AS WELL AS FINISHING PROFILE, FOR A FINISHING SET, AND METHOD FOR MANUFACTURING A FINISHING PROFILE AND A SKIRTING BOARD

(75) Inventors: Benny Schacht, Elverdinge (BE); Pieter Buyck, Ghent (BE)

(73) Assignee: Flooring Industries Limited, Sarl, Bertrange (LU)

( * ) Notice: Subject to any disclaimer, the term of this patent is extended or adjusted under 35 U.S.C. 154(b) by 1046 days.

(21) Appl. No.: 11/599,394

(22) Filed: Nov. 15, 2006

(65) Prior Publication Data

US 2007/0056239 A1 Mar. 15, 2007

Related U.S. Application Data

(63) Continuation of application No. 11/266,588, filed on Nov. 4, 2005.

(60) Provisional application No. 60/685,496, filed on May 31, 2005.

(30) Foreign Application Priority Data

Jan. 12, 2005 (BE) ..... 2005/0015
Jul. 4, 2005 (BE) ..... 2005/0336

(51) Int. Cl.
*E04F 13/26* (2006.01)
*E04F 19/02* (2006.01)

(52) U.S. Cl. ..... 52/717.04; 52/718.04; 52/716.1; 52/716.8; 52/718.01; 52/717.05; 52/211; 52/312; 52/464; 52/465; 52/467; 52/468

(58) Field of Classification Search ..... 52/204.53, 52/312, 464, 466–468, 592.1, 287.1, 716.1, 52/716.2, 716.8, 718.04, 717.04, 717.05, 52/211, 459, 475.1
See application file for complete search history.

(56) References Cited

U.S. PATENT DOCUMENTS 1,357,713 A 11/1920 Lane
2,363,429 A 11/1944 Lowry
2,449,904 A 9/1948 Lorraine
2,996,751 A 8/1961 Roby et al.
(Continued)

FOREIGN PATENT DOCUMENTS

CN 2495741 Y 6/2002
(Continued)

OTHER PUBLICATIONS

International Patent Application PCT/EP2005/014200, Informal reply to the written opinion of the International Searching Authority.

*Primary Examiner* — Jeanette E. Chapman
(74) *Attorney, Agent, or Firm* — Bacon & Thomas, PLLC

(57) ABSTRACT

Finishing set for a floor covering, whereby this finishing set at least consists of, on the one hand, a finishing profile and, on the other hand, a holder with at least an attachment portion for attaching said finishing profile at the holder, characterized in that the holder comprises an underlay portion, which at choice can or cannot be provided underneath the remaining portion of the holder, as well as a stop-forming positioning portion.

17 Claims, 18 Drawing Sheets

U.S. PATENT DOCUMENTS

| | | | | | |
|---|---|---|---|---|---|
| 3,199,258 | A | * | 8/1965 | Jentoft et al. | 52/222 |
| 3,254,361 | A | * | 6/1966 | Craven et al. | 16/16 |
| 3,296,056 | A | | 1/1967 | Bechtold | |
| 3,303,626 | A | * | 2/1967 | Brigham | 52/717.05 |
| 3,339,329 | A | | 9/1967 | Berg | |
| 3,411,977 | A | * | 11/1968 | Slater, Jr. | 428/33 |
| 3,543,326 | A | * | 12/1970 | Rohrberg et al. | 16/16 |
| 3,590,541 | A | * | 7/1971 | Epstein et al. | 52/311.1 |
| 3,665,666 | A | * | 5/1972 | Delcroix | 52/461 |
| 3,671,369 | A | | 6/1972 | Kvalheim et al. | |
| 3,688,460 | A | * | 9/1972 | Van Loghem et al. | 52/466 |
| 3,696,575 | A | | 10/1972 | Armstrong | |
| 4,059,933 | A | | 11/1977 | Funk et al. | |
| 4,067,155 | A | * | 1/1978 | Ruff et al. | 52/105 |
| 4,198,455 | A | | 4/1980 | Spiro et al. | |
| 4,385,850 | A | * | 5/1983 | Bobath | 403/205 |
| 4,478,660 | A | | 10/1984 | Landler et al. | |
| 4,557,779 | A | | 12/1985 | Bower et al. | |
| 4,653,138 | A | * | 3/1987 | Carder | 16/4 |
| 4,707,894 | A | * | 11/1987 | Friedwald | 24/459 |
| 5,074,089 | A | | 12/1991 | Kemmer et al. | |
| 5,155,952 | A | * | 10/1992 | Herwegh et al. | 52/100 |
| 5,203,941 | A | | 4/1993 | Spain et al. | |
| 5,391,340 | A | | 2/1995 | Mirous et al. | |
| 5,551,201 | A | * | 9/1996 | Anderson | 52/717.05 |
| 5,700,555 | A | | 12/1997 | Grill | |
| 5,706,623 | A | * | 1/1998 | Brown | 52/718.04 |
| 5,794,399 | A | * | 8/1998 | Searer | 52/718.01 |
| 5,858,522 | A | * | 1/1999 | Turk et al. | 428/308.8 |
| 5,939,670 | A | * | 8/1999 | Shteynberg et al. | 174/481 |
| 6,038,733 | A | * | 3/2000 | Carder et al. | 16/16 |
| 6,110,316 | A | | 8/2000 | Kobayashi et al. | |
| 6,141,920 | A | | 11/2000 | Kemper | |
| 6,230,385 | B1 | * | 5/2001 | Nelson | 29/450 |
| 6,286,920 | B1 | | 9/2001 | Ridgway | |
| 6,345,480 | B1 | | 2/2002 | Kemper et al. | |
| 6,438,914 | B1 | * | 8/2002 | Robertson | 52/255 |
| 6,517,935 | B1 | | 2/2003 | Kornfält et al. | |
| 6,550,192 | B1 | * | 4/2003 | Nelson et al. | 52/177 |
| 6,565,919 | B1 | | 5/2003 | Hansson et al. | |
| 6,588,165 | B1 | * | 7/2003 | Wright | 52/506.05 |
| 6,641,696 | B1 | | 11/2003 | Edgerton | |
| 6,699,352 | B2 | | 3/2004 | Sawatsky | |
| 6,737,122 | B2 | | 5/2004 | Beck et al. | |
| 6,745,534 | B2 | | 6/2004 | Kornfalt | |
| 6,805,951 | B2 | | 10/2004 | Kornfält et al. | |
| 6,860,074 | B2 | * | 3/2005 | Stanchfield | 52/464 |
| 6,898,911 | B2 | | 5/2005 | Kornfalt et al. | |
| 7,065,931 | B2 | * | 6/2006 | Kornfalt et al. | 52/395 |
| 7,207,143 | B2 | * | 4/2007 | Stanchfield | 52/459 |
| 7,640,706 | B2 | * | 1/2010 | Stanchfield | 52/464 |
| 2002/0061389 | A1 | | 5/2002 | Brooker et al. | |
| 2003/0024190 | A1 | | 2/2003 | Stanchfield | |
| 2003/0051426 | A1 | | 3/2003 | Kornfalt | |
| 2003/0084634 | A1 | | 5/2003 | Stanchfield | |
| 2003/0118812 | A1 | | 6/2003 | Kornfalt et al. | |
| 2003/0154678 | A1 | * | 8/2003 | Stanchfield | 52/468 |
| 2003/0159389 | A1 | | 8/2003 | Kornfalt et al. | |
| 2004/0007892 | A1 | * | 1/2004 | Harata et al. | 296/39.1 |
| 2004/0026017 | A1 | | 2/2004 | Taylor et al. | |
| 2004/0029030 | A1 | | 2/2004 | Murray | |
| 2004/0206038 | A1 | | 10/2004 | Stanchfield | |
| 2004/0258907 | A1 | | 12/2004 | Kornfalt et al. | |
| 2005/0003149 | A1 | | 1/2005 | Kornfalt et al. | |
| 2005/0150182 | A1 | | 7/2005 | Stanchfield | |
| 2005/0166526 | A1 | | 8/2005 | Stanchfield | |
| 2005/0217193 | A1 | | 10/2005 | Kornfalt et al. | |
| 2005/0229517 | A1 | | 10/2005 | Gomez Insa | |
| 2005/0247216 | A1 | | 11/2005 | Reichwein et al. | |
| 2005/0249923 | A1 | | 11/2005 | Reichwein et al. | |
| 2005/0249924 | A1 | | 11/2005 | Reichwein et al. | |
| 2005/0249929 | A1 | | 11/2005 | Reichwein et al. | |
| 2007/0107342 | A1 | * | 5/2007 | Friedlich | 52/311.1 |
| 2008/0075859 | A1 | | 3/2008 | Baker et al. | |

FOREIGN PATENT DOCUMENTS

| | | | |
|---|---|---|---|
| DE | 36 40 822 | | 6/1988 |
| DE | 93 01 717 | | 5/1993 |
| DE | 297 11 389 | | 10/1997 |
| DE | 298 22 236 | | 4/1999 |
| DE | 202 06 101 | U1 | 10/2002 |
| DE | 20 2004 018 094 | | 3/2005 |
| DE | 200 23 643 | | 5/2005 |
| DE | 20 2005 004 624 | | 8/2005 |
| EP | 0 788 576 | | 8/1997 |
| EP | 1 010 836 | | 6/2000 |
| EP | 1 113 124 | | 7/2001 |
| EP | 1 310 613 | | 5/2003 |
| EP | 1 310 613 | A2 | 5/2003 |
| EP | 1 319 578 | A2 | 6/2003 |
| EP | 1 836 363 | A0 | 7/2006 |
| EP | 1 841 573 | A0 | 8/2006 |
| GB | 2 121 465 | | 12/1983 |
| JP | 2000 210909 | A2 | 8/2000 |
| JP | 2004 211469 | A | 7/2004 |
| WO | WO 01/20101 | | 3/2001 |
| WO | WO 2005/083195 | | 9/2005 |
| WO | WO 2005/083196 | | 9/2005 |
| WO | 2006/074824 | A2 | 7/2006 |
| WO | 2006/079468 | A1 | 8/2006 |
| WO | WO2006/079468 | | 8/2006 |
| WO | WO2006/093866 | | 9/2006 |

* cited by examiner

FINISHING SET FOR A FLOOR COVERING AND HOLDER, AS WELL AS FINISHING PROFILE, FOR A FINISHING SET, AND METHOD FOR MANUFACTURING A FINISHING PROFILE AND A SKIRTING BOARD

This application is a continuation application of application Ser. No. 11/266,588 filed 4 Nov. 2005 which claims the benefit of provisional application No. 60/685,496 filed 31 May 2005 and Belgian applications BE 2005/0015 filed 12 Jan. 2005 and BE 2005/0336 filed 4 Jul. 2005.

This invention relates to a finishing set for a floor covering, as well as to a holder and a finishing profile for such finishing set. Moreover, it also relates to a method for manufacturing a finishing profile and a skirting board.

More particularly, the invention relates to a finishing set consisting of at least one holder and at least one finishing profile that can be attached on the holder.

In particular, the invention is intended for being used in combination with floatingly installed floor coverings, such as floatingly installed floor panels, for example, laminate panels, prefabricated parquet, veneer parquet, or solid parquet. However, this does not exclude its application in combination with other floor coverings.

When installing floor coverings, in particular with floatingly installed floor coverings, in a large number of cases measures have to be taken in order to finish the edges thereof. Such edges to be finished may occur at the end of the floor covering, for example, against a wall, at a transition to another type of floor covering, or when providing an extension joint between two floor coverings, said floor coverings either being of different nature or not, by which, amongst others, of different material or of different thickness is meant.

It is known that to this aim, use can be made of a finishing set consisting, as aforementioned, of at least one holder and at least one finishing profile that is attachable on the holder, said finishing profile allowing to thereby cover the respective edge or transition, and thus forming, in most cases, also an esthetically attractive transition.

Hereby, the holder mostly consists of a rail-shaped profile, which can be attached on the subfloor, for example, by means of gluing, screwing, nailing or simply by installing this profile partially underneath the floor covering. Mostly, the holder also comprises an attachment portion for attaching a finishing profile at the holder.

Usually, such finishing profile is realized as a decorative strip or such, whether or not consisting of several parts, which can be pressed into the rail-shaped profile for attachment. Further, it is known that such finishing profile can be realized in the form of an end profile, transition profile as well as an expansion profile or a combination thereof. End profiles mostly serve for the finish against a wall, transition profiles for the transition from one type of floor covering to another type, and expansion profiles for bridging-over an expansion joint between two portions of a floor covering.

It is also known that the components of such finishing set may be realized in different materials, such as, for example, aluminum, wood, synthetic material or a wood-based material, for example plywood, MDF/HDF, and the like. It is also known to apply combinations, whereby the holder consists of a well-defined material, for example, aluminum or synthetic material, whereas the finishing profile consists of another material, for example, a wood-based material. Hereby, the finishing profile may or may not be encased by a layer-shaped covering, whether or not matching the floor covering, and which can be of any kind and, for example, may consist of a foil or laminate as well as lacquer or the like.

Such finishing sets and the composing parts thereof are known, amongst others, from the patent documents EP 1 310 613, WO 03/040492, WO 01/2010, WO 96/12857, U.S. Pat. No. 6,550,192, DE 198 54 452, DE 93 01 719, DE 198 54 452, DE 203 20 273, and BE 531.202.

From these documents, it is also known that the holders and/or finishing profiles may be equipped with particular features. So, for example, it is known from EP 1 310 613 to provide a break-off underlay portion at the holder, which portion, in broken-off condition, can be placed underneath the remaining portion of the holder in order to obtain that the holder can also be used with thicker floor coverings. In DE 198 54 452, the same technical problem is solved by providing an adapter between the holder and the finishing profile. DE 203 20 273 shows how the finishing portion, for attaching a finishing profile on the holder, can be provided with means allowing an inclination of the finishing profile. From WO 01/20101 and WO 03/040492, it is known that the finishing profile as such can be composed of different parts.

According to a first aspect, the invention aims at an improved finishing set of the above-mentioned type, with a combination of characteristics allowing that such finishing set can be applied rather universally in an optimum manner. To this aim, the invention, according to the first aspect, relates to a finishing set for a floor covering, whereby this finishing set consists at least of, on the one hand, a finishing profile and, on the other hand, a holder with at least an attachment portion for attaching said finishing profile to the holder, with as a characteristic that the holder comprises an underlay portion that at choice can be or cannot be provided underneath the remaining portion of the holder, as well as a stop-forming positioning portion. Preferably, the underlay portion and the positioning portion will be located at opposite sides of the attachment portion.

By an "underlay portion", a portion must be understood that is associated with the holder and preferably is formed in one piece therewith, which, at choice and in function of the application, can be placed by the user underneath the remaining portion of the holder, such that this remaining portion and the associated attachment portion can be situated at different heights above the subfloor. Preferably, the underlay portion of the holder is realized as a laterally extending portion which is removable from this lateral position, such that in this manner, the underlay portion can be put underneath the remaining portion of the holder.

By means of a finishing set according to the first aspect, it is achieved, on the one hand, that the position of the holder can be adapted to the thickness variations of floor coverings and/or underlayments, and, on the other hand, in case that a finishing profile is applied that functions as an end profile, the holder, by means of the stop-forming positioning portion, can be attached upon the subfloor in such a manner that the end profile, after being mounted on the holder, automatically will arrive at the desired final position. More particularly, this relates to an end profile of the type suitable for forming a finish along a stop-forming part, such as a wall or the like, whereby said end profile has an end wall that is intended for being directed towards the stop-forming part. Preferably, the holder and the finishing profile are realized such that, when the holder, by means of its positioning portion, is positioned against said stop-forming part, the finishing profile, with its aforementioned end wall, precisely adjoins against said stop-forming part. Hereby, it is preferred that, in freely mounted position, the stop-forming positioning portion of the holder and said end wall of the finishing profile lie in the same vertical plane. By "freely mounted position", the position is meant in which the finishing profile is mounted in the holder, however, is not shifted against a stop-forming part, such as a wall or the like.

In a preferred embodiment of the invention according to the first aspect, the holder of the finishing set comprises an underlay portion, either the aforementioned underlay portion or another underlay portion, whereby this underlay portion can take at least a first and a second position in respect to the remaining portion of the holder, and whereby, in the second position, it functions as an underlay portion for said remaining portion. Hereby, the underlay portion can be brought from the first position into the second. To this aim, the holder has one or more of the following features:

- the holder comprises means for separating the underlay portion from the remaining portion, such that the underlay portion can be put underneath the remaining portion;
- the holder comprises means, as defined in the preceding paragraph, whereby those are selected from the following series: a cutting line, a break-off line, a tear-off line, a weakened material part, for example in the form of a reduced section or a perforation;
- the holder comprises means for bringing the underlay portion, by means of an angling movement, from the first position into the second position;
- the holder comprises means, as defined in the preceding paragraph, said means being selected from the following series: a mechanical hinge, a foldable portion, a foldable portion consisting of a more flexible material than the material of the holder and being manufactured by means of co-extrusion with the rest of the holder.

Possibly, also other portions of the holder, such as a positioning portion or an attachment portion, can assume different positions. Preferably, also the stop-forming positioning portion can be removable from its position, either by being able to be put into another position while being connected to the remaining portion of the holder, or by being completely separable.

The possibility of changing the position of certain portions, either by detaching those portions, or by angling them into another position, in which the respective portion then either exerts another function or not, provides for that this type of holder can be applied in a rather universal manner. For example, such holder offers the possibility to shorten the holder or to heighten it, such that it, for example, remains utilizable with different widths of expansion joints and different thickness variations of floor panels and/or underlayments.

Further, the invention also relates to a holder for a finishing set, which is improved in accordance with the first aspect of the present invention. To this aim, the invention relates to a holder allowing to realize a finishing set according to the first aspect of the invention, whereby the holder comprises at least an attachment portion for attaching a finishing profile to the holder, characterized in that the holder further comprises an underlay portion, which at choice can or cannot be provided underneath the remaining portion of the holder, as well as a stop-forming positioning portion.

According to a second aspect, the invention aims at an improved holder for attaching a finishing profile, with a combination of characteristics, such that the holder can be applied rather broadly. To this aim, the invention, according to the second aspect, relates to a holder for attaching a finishing profile for a floor covering, whereby said holder comprises a base as well as at least an attachment portion for attaching a finishing profile upon the holder, and whereby the base has two free edge portions situated at opposite sides of the attachment portion, characterized in that at least one edge portion is realized as an underlay portion, whereby it can be removed from its position as a free edge portion in order to be placed underneath the remaining portion of the holder, and whereby the widths of both edge portions, measured respectively from the attachment portion up to the distal end of the respective edge portion, differ from each other.

The above-mentioned characteristics of the second aspect of the present invention offer an interesting combination of usage possibilities in one holder. The free edge portions of the holder allow to slide both respective edge portions under the floor covering, in the case that use is made of a finishing profile that is realized as a transition profile or an expansion profile, such that the holder automatically is held at its location. With such mounting, it is also possible to bridge-over thinner expansion gaps or to effect shorter transitions. If desired, then less wide finishing profiles can be employed, such that a more elegant transition is created. If it is not possible to slide both edge portions under the floor covering, for example, when the finishing profile is applied as an end profile, the holder offers the possibility to slide the short or the long edge portion under the floor, such that, as desired, a wide or a narrow transition can be effected. With the holder according to this second aspect, moreover a free edge portion remains applicable as an underlay portion, such that the advantages of the present invention, according to the first aspect, in respect to situating the holder at different heights above the underlying floor, are maintained.

According to a preferred form of embodiment of the present invention according to this second aspect, both edge portions can be removed from their position. As both edge portions moreover have a different width, in a single holder four possible configurations are created, namely the complete holder, the holder having the narrow edge portion removed from its position, the holder having the wide edge portion removed from its position, and the holder having both edge portions removed from their respective positions.

With the aim of performing one or both of the aforesaid free edge portions as being removable from their positions, the holder, according to a preferred embodiment of the invention, has one or more of the following features:

- the holder comprises means for removing the respective free edge portion from the remaining portion, such that this edge portion can be put underneath the remaining portion;
- the holder comprises means, as defined in the preceding paragraph, whereby those are selected from the following series: a cutting line, a break-off line, a tear-off line, a weakened material part, for example in the form of a reduced section or a perforation;
- the holder comprises means for angling the respective free edge portion between the position in which it functions as a free edge portion, and a position differing therefrom, preferably a position in which it functions as an underlay portion;
- the holder comprises means, as defined in the preceding paragraph, said means being selected from the following series: a mechanical hinge, a foldable portion, a foldable portion manufactured by means of co-extrusion with the remainder of the holder and consisting of a more flexible material than the material of the holder.

According to a third aspect, the invention aims at an improved holder for attaching a finishing profile, with a combination of characteristics, such that the holder can be applied rather broadly and can be re-used. To this aim, the invention, according to the third aspect, relates to a holder for attaching a finishing profile for a floor covering, whereby this holder comprises at least a first portion with an attachment portion for attaching the finishing profile to the holder, as well as at least a second portion with a function preferably differing from the function of the aforementioned attachment portion, characterized in that the second portion is hingeably connected to the first portion and thereby can be pivoted along an axis, whether fictive or not, said axis being parallel or substantially parallel to the direction of a finishing profile attached in the attachment portion.

The second portion, which, according to the third aspect, is connected to the first portion in a hinged manner, promotes the applicability of the holder in a similar manner as the removable attachment portion according to the second aspect of the invention. The second portion of the holder pivots around an axis, whether fictive or not, either towards a non-operative position, where the respective portion does not fulfill any function, or towards an operative position, where the respective portion indeed fulfills a certain function, such as, for example, that of an underlay portion, more particularly an underlay strip. Several operative positions of the second hinged part are possible. For instance, the second portion can be realized as a laterally extending flange, resulting in that, in its initial position, it also assumes an operational position; for example, this second portion may be put underneath the floor covering in order to attach the holder on the subfloor.

An additional advantage of the holder according to this aspect of the invention is that it may be re-used in any configuration, in view of the fact that the folding down of the edge portions is reversible and the holder, after use, can be brought back into its initial position by simple means.

According to a preferred embodiment of the invention according to this third aspect, the hinge consists of a foldable portion preferably manufactured of a more flexible material than the material of which the first and second portions are manufactured. According to this preferred embodiment, the entire holder then preferably is produced in one step, for example, by co-extrusion. With such hinge, the axis around which the second portion pivots, can be considered fictive, in view of the fact that the pivoting movement is the result of folding of material and that no actual axis can be indicated.

According to a fourth aspect, the invention relates to a holder for a finishing profile of a floor covering with improved ease of application. To this aim, the invention relates to a holder for attaching a finishing profile for a floor covering, whereby this holder comprises at least a first portion with an attachment portion for attaching the finishing profile on the holder, as well as at least a second portion, whether or not realized in one piece with the first portion, said second portion being realized as an underlay portion for the first portion, characterized in that the holder is provided with positioning means, more particularly mechanical positioning means, which, when the second portion is applied as an underlay portion underneath the first portion, effect a positioning in transverse direction among both portions.

According to this fourth aspect, the invention allows to position, or attach, the underlay portion in an easy manner underneath the first portion of the holder, such that this underlay portion properly supports the first portion of the holder and/or, in doing so, does not shift during usage. Such positioning means may be restricted to a stop or, according to a preferred form of embodiment, may consist of locking means, and, even more preferred, a snap connection, as a result of which the first and second portions can be attached upon each other.

According to a fifth aspect, the invention aims at an improved holder for attaching a finishing profile with a well-defined combination of characteristics, such that this holder, too, can be applied rather broadly. To this aim, the holder, on the one hand, comprises at least a first portion with an attachment portion for attaching the finishing profile on the holder and with a basis with which this first portion can be attached on a subfloor, as well as, on the other hand, at least a second portion, whether or not made in one piece with the first portion, characterized in that the second portion consists of an adjustment portion, with which the first portion can be put at an angle in respect to a subfloor.

In a preferred form of embodiment of the invention according to this fifth aspect, the second portion consists of an adjustment portion, which, when being used, urges the holder to take a tilted position. This adjustment portion may be made, for example, wedge-shaped. A wedge-shaped adjustment portion, when placed underneath the holder, offers the possibility to attach the holder on the subfloor in an inclined manner, such that an inclination of the finishing profile is obtained, which preferably is larger than the inclination that can be achieved by clamping the finishing profile obliquely into the attachment portion. This larger inclination allows to effect a transition between two floor coverings of differing thickness, whereby the height difference between both floor coverings can not be bridged solely by the inclination of the finishing profile in the attachment portion of the holder. According to a variant, the adjustment portion is configured such that it is suited for being provided underneath one side of the basis of the first portion, such that, with such mounting, the holder also becomes inclined.

According to a sixth aspect, the present invention aims at an improved finishing profile, with a combination of characteristics allowing that such finishing profile can be applied rather universally in an optimum manner. To this aim, the invention relates to a finishing profile for a floor covering, which, from manufacturer's side, is constructed such that it comprises a flange-shaped portion, with, in the proximity of only one edge thereof, a nose portion situated substantially underneath it, characterized in that the nose portion is attached to the remaining portion of the finishing profile as a one-piece, however, separable portion.

According to this sixth aspect, the invention relates to a rather universal finishing profile, which, in a preferred form of embodiment, comprises a flange-shaped portion extending at the right and left hand sides of an attachment portion of the finishing profile situated at the bottom side and having a decorative side at least on the upper side of the flange-shaped portion. In the same preferred form of embodiment, the nose portion extends at one edge of the flange-shaped portion at least downward and has a laterally-facing decorative side adjoining the decorative side of the flange-shaped portion. The finishing profile obtained according to this preferred form of embodiment allows, for example, to apply this finishing profile at choice as an end or expansion profile, thus, starting from one and the same factory-made finishing profile. To this aim, the factory-made finishing profile as a whole will be employed as an end profile, and, if the user wants to employ the factory-made finishing profile as an expansion profile, he will separate the nose portion from the finishing profile by simple means in order to thereby keep only the flange-shaped portion as an expansion profile. Other flange-shaped portions and nose portions with other usage possibilities are not excluded. As a nose portion is present at only one edge, the finishing profile remains rather un-complex. Also, in order to arrive at an expansion profile, only one nose portion must be removed, such that, in such case, waste is restricted to a minimum.

According to a seventh aspect, the present invention aims at an improved and simple to produce finishing profile, with a combination of characteristics allowing for a universal applicability of such finishing profile in an optimum manner and for the application-friendliness thereof. To this aim, the invention relates to a finishing profile for a floor covering, said profile comprising a body formed by means of extrusion, characterized in that it has at least two portions that are mutually separable, but made in one piece, such that, by either separating or not separating those portions from each other, distinct usage possibilities for the remaining finishing profile are obtained.

Extrusion is a very recommended method for producing elongated, thin-walled objects of synthetic material, aluminum, paper pulp or wood-based materials, such as the finishing profile of the present invention, according to this seventh aspect. Production with extrusion allows to manufacture one-piece, however, separable, portions in an inexpensive and versatile manner. According to a preferred embodiment of the invention, to this aim one or more weakened parts shall be extruded in the body of the finishing profile, where the separably realized portions can be broken off, torn off or cut off.

The presence of several separable portions allows the application of one and the same finishing profile as a transition profile, expansion profile and/or end profile. To this aim, in a preferred form of embodiment, one of said portions is made as a flange-shaped portion extending on the left and right hand sides of an attachment portion located at the lower side thereof, whereas the other portion is made as a nose portion extending downward from one edge of the flange-shaped portion.

Still more preferably, the finishing profile consists of at least three separable portions, namely, a flange-shaped portion extending on the left and right hand sides of an attachment portion situated at the lower side thereof, a nose portion situated in the proximity of one edge of the flange-shaped portion and having a downward-sloping outer surface, and a nose portion located in the proximity of the second edge of the flange-shaped portion with an outer surface that is globally steeper than said outer surface of the first-mentioned nose portion.

In this form of embodiment, the flange-shaped portion can be made such that the finishing profile, when removing both nose portions, can be applied as an expansion profile. However, by keeping the nose portions with a downward-sloping outer surface at the flange-shaped portion, the finishing profile can also be applied as a transition profile. By keeping, however, the nose portion showing said steeper outer surface at the flange-shaped portion, a finishing profile is obtained that can be applied as an end profile.

According to an eighth aspect, the present invention aims at an improved and simple to produce finishing profile, with a combination of characteristics allowing a universal applicability of such finishing profile in an optimum manner and being user-friendly. To this aim, the invention according to this eighth aspect relates to a finishing profile consisting at least of a body, formed by several portions, whereby two or more of these portions can be mutually separated or combined in function of the intended application, characterized in that the body is at least partially encased by means of a layer-shaped covering, which, in the non-separated or combined condition of at least two of said portions, extends or can extend at least over the transition between those portions.

This aspect of the invention offers the possibility of a finishing profile with a layer-shaped covering, such covering whether or not matching the floor covering, whereas the advantages of the universal finishing profile from the seventh aspect of this invention are maintained. Moreover, the layer-shaped covering hides transitions between the separable and/or combinable portions of the body of the finishing profile.

A finishing profile according to the eighth aspect of the invention may be obtained, for example, by sawing or milling a one-piece coated semi-finished product up to directly underneath the layer-shaped covering in order to thereby obtain separable and/or combinable portions. In this case, the separable and/or combinable portions will be connected by the layer-shaped covering and possibly in addition by a remaining weakened material portion. The separable and/or combinable portions may also be connected solely by the layer-shaped covering. It is clear that a configuration, where the separable and/or combinable portions are connected by the layer-shaped covering and possibly additionally by a remaining weakened material portion, also may be obtained by other techniques.

In a preferred form of embodiment, the mutual separability of two portions can be obtained by the possibility of cutting, breaking off, tearing off or the like the layer-shaped covering and the possibly present weakened material portion directly underneath this layer-shaped covering. To this aim, preferably a tool, such as a knife, is used.

Another possibility for effecting the mutual separability of two portions consists in that at least one of these portions is made detachable from the layer-shaped covering adjoining it. According to a variant of this form of embodiment, it is also possible to offer a flange-shaped encased portion, whereby the layer-shaped covering of this flange-shaped portion, along one or both edges thereof, continues into a portion, which preferably is provided with an adhesive at the inside, whether or not said adhesive being covered with a protective layer, and in order to offer, together with this flange-shaped portion, one or more un-encased nose portions. The user then can decide whether he wants to employ a nose portion. If he wants to do so, then he will position the nose portion underneath the flange-shaped portion and subsequently will provide the aforementioned continuing portion of the layer-shaped covering at least partially over the exterior of the nose portion, and preferably up to under the nose portion. Hereby, the transition between the two portions of the body of the finishing profile, namely the flange-shaped portion and the nose portion, in combined condition, is covered. If the user does not want to employ a nose portion, he may either remove the layer-shaped covering continuing at the edge of the flange-shaped portion, or adhere this layer-shaped portion at least partially against the lower side of the flange-shaped portion.

According to a preferred form of embodiment of the present invention, the respective separable and/or combinable portions adjoin directly against each other. In this form of embodiment, the finishing profile then also consists of loose parts, which are connected to each other solely by means of the layer-shaped covering. This form of embodiment offers the possibility of an easier production than described above. First, the separate parts are manufactured, for example, by means of sawing, milling, extruding, and subsequently the parts are assembled and encased with a layer-shaped covering. It is not excluded that, between the assembly step and the encasing, a treatment is performed that guarantees the precision of the assembled, not-encased assembly. For example, the outwardly directed sides of the assembled portions can be commonly cut to size, such that the subsequent encasing thereof is facilitated and/or that the encasement quality is maximum. By this, for example, is meant that no, or almost no, lines will appear at the height of the aforementioned transition between two portions.

A production as described hereabove prevents, such as when sawing up to closely underneath the layer-shaped covering of a semi-finished product, the presence of saw cuts between two separable and/or combinable portions. Such saw cuts mostly are undesirable, as they mean a significant weakening of the finishing profile, which will lead to a bad clamping of the profile, and also will result in that the finishing portions of the floor covering will be prematurely damaged by being walked upon.

According to another form of embodiment of the invention according to this eighth aspect, the respective separable and/or combinable portions, instead of exclusively at the layer-shaped covering and possibly a portion directly underneath the layer-shaped covering, moreover are additionally connected or attached to each other by means of locking means. These locking means preferably shall consist of a snap connection or a releasable adhesive connection.

The separable and/or combinable portions of such finishing profile may be manufactured, for example, of wood or a wood-based material. Preferably, they consist of MDF/HDF or plywood.

Within the scope of the invention, it is not excluded that the separable and/or combinable portions are manufactured of other materials, for example, by means of extrusion of synthetic material, paper pulp, or the like.

Also, said portions for forming one and the same finishing profile may be manufactured of different materials. So, for example, may the flange-shaped portion consist of a wood-based material, such as MDF/HDF, and may the nose portions be manufactured of synthetic material. Within the scope of the invention, various combinations of materials are possible and offer the advantage that the most suitable material in respect to production manner and usage function for each separate part can be chosen.

In general, a finishing profile consisting of multiple separable and/or combinable portions will consist of, on the one hand, a flange-shaped portion with an attachment portion situated at the lower side, and, on the other hand, at least one nose portion located, in the non-separated or combined condition, substantially underneath the flange-shaped portion.

In the case that such finishing profile, as aforementioned, consists of several separable and/or combinable portions, two or more mutually adjacent portions thereof, apart from the fact that they possibly differ from each other in shape, may be made in another, clearly differentiating manner for the user, for example, in that they differ from each other in at least one of the following ways:

- they have a different colour, which, for example, has been obtained by colouring the material; they are formed of different material;
- they have a different print, for example, of a specific instruction for use for each respective portion, for example, provided on the underside.

This makes it possible for the user to easily see that the finishing profile is composed or can be composed of different portions. Possibly, the function of the portions may be made clear in a simple manner by means of the aforementioned differences. This is of prior importance when, for example, several nose portions differing from each other are commonly packaged.

According to a ninth aspect, the present invention relates to a finishing profile for a floor covering of the type consisting at least of two portions, whereby the first portion is a flange-shaped portion with an attachment portion located at the lower side, whereas the second portion consists of a nose portion that can cooperate with the lower side of the flange-shaped portion, in such a manner that, by applying or not applying the nose portion, at least two usage possibilities are created.

A finishing profile of such type is known, for example, from the patent document WO 03/040492, in which the cooperation between the nose portion and the flange-shaped portion either consists of an adhesive connection, which is provided on the lower side of the flange-shaped portion from manufacturer's side, or of a coupling part protruding from the flange-shaped portion and engaging in the upper side of the nose portion. This known finishing profile shows a number of disadvantages, when the flange-shaped portion is employed without the nose portion, for example, in the function of an expansion profile. The adhesive connection may contact the floor covering, in which, by means of the flange-shaped portion, an expansion joint is being finished. In this case, the expansion of the flooring will be undesirably counteracted by the adhesive connection. In the case that the flange-shaped portion has a protruding coupling portion, this coupling portion, when applying solely the flange-shaped portion for finishing, for example, an expansion joint, will limit the minimum width of the expansion joint possibly to be finished, in view of the fact that the protruding coupling part will limit the distance over which the floor covering can be slid underneath the flange-shaped portion. Moreover, the distance by which the flange-shaped portion reaches over the floor covering often will be too small for offering a good cover under all circumstances.

In order to remedy the above disadvantages, the invention according to this ninth aspect relates to a finishing profile for a floor covering, said profile consisting of at least two portions, whereby the first portion is a flange-shaped portion with an attachment portion located at the lower side, whereas the second portion consists of a nose portion that can cooperate with the lower side of the flange-shaped portion, in such a manner that, by either applying or not applying the nose portion, two usage possibilities are created, characterized in that between the first and second portions, attachment means are present at least in the form of an adhesive provided on the nose portion from manufacturer's side, with which adhesive the first and the second portion can be connected to each other, whereby these attachment means either can or cannot be further completed by a coupling part protruding from the nose portion and engaging in the lower side of the flange-shaped portion and offering at least a locking in lateral direction. Hereby, the adhesive may cooperate directly with the lower side of the flange-shaped portion, or with a part present at the lower side of the flange-shaped portion.

According to this ninth aspect, the cooperation between the flange-shaped portion and the nose portion thus can not form any limitation for employing solely the flange-shaped portion, for example, when applying this portion as an expansion profile for finishing an expansion joint. In such case, there actually is no disadvantageous glue connection, nor are there any hampering protruding portions at the lower side of the flange-shaped portion.

In a particular form of embodiment, the invention according to the ninth aspect also consists of a set of components for forming a finishing profile of the above-mentioned type, characterized in that this set at least consists of said first portion and said second portion, whereby these are commonly packaged, and whereby, at least in the case of an adhesive connection, both portions are apart from each other and preferably the adhesive provided on the nose portion is provided with a removable protective layer. Still more preferably, the set of components shall comprise at least two different nose portions, which at choice can be used together with the first portion, whereby both nose portions preferably are packaged together with the first portion.

According to the ninth aspect, the invention also relates to a nose portion for realizing a set of components, characterized in that this nose portion comprises attachment means, either at least in the form of an adhesive that is provided on the nose portion from manufacturer's side, or at least in the form of a coupling part protruding from the nose portion, whereby this nose portion, in the case of an adhesive, preferably is provided with a removable protective layer.

According to a tenth aspect, the invention also relates to a set of components for forming a finishing profile of the above-said type, more particularly a finishing profile consisting of at least two portions, whereby the first portion is a flange-shaped portion with an attachment portion located at the bottom side, whereas the second portion consists of a nose portion that can cooperate with the lower side of the flange-shaped portion, such that, by using or not using the nose portion, two usage possibilities are created, characterized in that this set also comprises connection means in the form of adhesive means, and in that at least the nose portion and the adhesive means are commonly packaged.

According to an eleventh aspect, the invention aims at a limited set of components, which nevertheless allow to form a large number of different finishing profiles. To this aim, the invention relates to a set of components for forming a finishing profile, whereby this set consists of at least two components, a first component and a second component, respectively, whereby the first component has a flange-shaped portion with an attachment portion located at the lower side, with as a characteristic that the second component, whether or not after being adapted, can cooperate with the first component in at least two usage positions. The possibly required adaptation may consist, for example, in that, in function of the desired usage position, one or more portions of the second component must be removed.

Preferably, the second component is made as a nose portion and has two sides which, in function of the desired usage position, can be turned outward, whereby, in function of the outwardly turned side, a different form of finishing profile is obtained, preferably a finishing profile in the form of an end profile or in the form of a transition profile, respectively.

In a preferred form of embodiment of the eleventh aspect, said two sides of the second component are realized as decorative sides, whereby each of these decorative sides, by positioning at least a portion of the second component in respect to the first component, can be brought into a position in which it adjoins the decorative side of the flange-shaped portion in order to thereby form, in this position, together with the first component, a finishing profile.

Of course, the flange-shaped portion can also be applied as such, for example, as an expansion profile.

It is clear that the invention also relates to finishing sets whereby a holder and a finishing profile are used according to any of the preceding aspects of the present invention.

It is noted that the possible layer-shaped covering, with which the finishing profiles according to the invention that are described herein above and below, as mentioned may consist of laminate, foil, veneer or such, and preferably has a high wear resistance. The laminate as such may consist of a carrier sheet impregnated in resin, upon which preferably a print is provided. Said wear resistance may be obtained by incorporating abrasive particles, such as, for example, aluminum oxide, in the layer-shaped covering. The application of the layer-shaped covering, for example, takes place by gluing it with a polyurethane or polyolefin glue. The use of polyolefin glue allows an easier covering of sharp edges than in the case when using polyurethane glue.

Further, it is noted that the covering of the finishing profile also can be solely built of different layers of colouring agent, such as ink, which preferably forms a pattern and may be covered by a lacquer or not. In the cases where the finishing profile consists of a body that is formed of several portions, as is the case, for example, with finishing profiles showing the characteristics of the eighth aspect of the invention, it is preferred to apply at least said pattern in the un-detached or combined condition of said portions.

An additional advantage of the different aspects of the invention is that the logistic exertion of the manufacturer is limited considerably. The existing manner of finishing a floor covering requires holders for each finishing profile and type of flooring, as well as finishing profiles for each type of finishing and type of flooring, surely if the manufacturer wants to provide matching finishing profiles. Having all these holders and finishing profiles in stock and offering them is expensive. More particularly, a manufacturer who wants to offer, for example, holders for two heights of floor covering will have to double his stocks. If he, moreover, also offers underlayments of various thickness and wants to have a holder in stock for each combination of underlayments and floor covering, then the exertion in the field of logistics will be larger than is acceptable. The finishing set, holders and finishing profiles, manufactured according to the present invention, restrict this inconvenience to a major extent, anyhow, at least in almost all forms of embodiment described above.

According to another particular independent aspect, thus, a twelfth aspect, the invention relates to a finishing profile consisting of a material that is easy to process, whereas these finishing profiles still have sufficient strength. To this aim, the invention, according to its twelfth aspect, relates to a finishing profile for a floor covering with a body, whether or not formed of several portions, amongst which a flange-shaped portion with an attachment portion located at the lower side, whereby said body, or anyhow at least the flange-shaped portion and the attachment portion, substantially consists of a material composed of several layers of wood, with as a characteristic that at least two of said layers have a different orientation of the wood fibers and preferably each layer has a different orientation of the wood fibers in respect to the layer situated thereabove, therebelow, respectively. In a practical form of embodiment, this is realized by manufacturing the respective body of so-called crosswise-layered plywood.

It is clear that said wood layers preferably extend parallel to the flanges of the flange-shaped portion.

By the variation of the orientation of the wood fibers, the finishing profile according to the twelfth aspect obtains, amongst others, an improved bending strength. Each separate layer of wood thus offers only a limited resistance against bending around an axis that is parallel to the direction of the wood fibers. The cooperation of separate layers of wood with different fiber orientations, according to the invention, now provides for that the finishing profile does not have an axis around which a bending encounters little resistance. Such axis is particularly detrimental when it is situated in the longitudinal direction of the finishing profile. In normal use, a bending around the longitudinal axis of the finishing profile will often occur, for example, when the user walks upon the finishing profile. A low resistance against bending around this longitudinal axis then may lead to that thin portions, such as, for example, the flanges of the flange-shaped portion, may break off prematurely.

According to a thirteenth aspect, the invention relates to a profile for finishing a floor covering, with as a characteristic that this profile is configured such that it is applicable both as a finishing profile and a skirting board. In a particular form of embodiment of this thirteenth aspect, the profile comprises several portions, whereby two or more of these portions, in function of the intended application, can be separated from each other or combined with each other, whereby in at least one application an assembly is obtained that is suitable for use as a skirting board, whereas at least in one other application an assembly is obtained that is suitable for use as a finishing profile.

According to a fourteenth aspect, the invention also relates to an accessory, with the characteristic that it shows one or more of the following three features:

- that it is configured to cooperate with a finishing profile in order to divide such finishing profile into two or more parts;
- that it has two or more usage functions, whereby at least one thereof consists of the application as a knife for dividing a finishing profile into two or more parts;
- that it has two or more usage functions, whereby at least one thereof consists of the application as a knife for dividing a finishing profile into two or more parts, whereas the other consists of the application as a tapping block.

According to a fifteenth aspect, the invention relates to a finishing profile, or portion for forming such finishing profile, that is provided with a pattern at its decorative side, characterized in that the pattern is formed at least partially, and preferably entirely, of a hardening, thus, also drying, substance, which is applied on the finishing profile or on the portion thereof and is hardened thereon. More particularly, hereby it is preferred that a printed pattern is used, whereby the intended hardening or drying substance then consists of ink or another substance that can be applied by means of a printer, such as a lacquer, which can be applied by means of a printing process.

This technique has as an advantage that no separate printed decorative layer for forming the layer-shaped covering, such as a imprinted encasing foil, laminate foil or the like must be formed, which has to be applied on the finishing profile in an accurate manner. An advantage resulting from this is that a smooth production is possible, in first instance, when the pattern is realized by means of a printer. Then, in fact, no separate stocks of printed decorative layer have to be provided. By controlling the aforementioned unit, more particularly, the printer, in a suitable manner, it is possible to switch to the production of another pattern at any moment.

Coupled to the fifteenth aspect, the invention also relates to a method for manufacturing a finishing profile or a portion of a finishing profile, characterized in that this method comprises at least a step wherein the finishing profile and/or said portion, either in completely finished form, or as a semi-finished product, are displaced relatively along a unit that applies a hardening substance in the form of a pattern on the finishing profile and/or said portion, more particularly, a printing unit, preferably an ink-jet printer, after which the substance is left to harden. Further characteristics of the fifteenth aspect will become clear from the detailed description.

According to a sixteenth aspect, the invention relates to a method for manufacturing a skirting board, whereby this skirting board is composed of one or more portions and one or more of these portions possess a decorative surface in the form of a pattern, characterized in that this method comprises at least a step wherein the skirting board and/or one or more portions thereof are displaced relatively along a unit that applies a hardening substance in the form of a pattern on the finishing profile and/or on said portion, more particularly, a printing unit, preferably an ink-jet printer, after which the substance is left to harden. Hereby, the same advantages are obtained as in the fifteenth aspect.

Both with a finishing profile according to the fifteenth aspect as with a skirting board according to the sixteenth aspect, it is possible to realize the entire pattern and/or the entire surface to be covered according to the presented technique, as well as only a portion thereof, whereas then the remaining portion of the pattern and/or of the surface to be covered will be realized by means of another technique, for example, by laminating in a press.

According to a seventeenth aspect, the invention relates to a finishing profile for a floor covering comprising a body that is formed of at least two portions, whereby these portions, in function of the intended application, can be separated from each other or brought together, and whereby the first of said portions shows a flange-shaped portion and the second of said portions is a nose portion that is or can be provided underneath the flange-shaped portion, with the decorative side of the nose portion adjoining to a downward-directed portion of the decorative side of the flange-shaped portion, characterized in that said first and second portions are formed of separate basic bodies; that the basic bodies themselves are free of mechanical connection parts fitting into each other, which are formed of the material of the basic bodies themselves; and that said basic bodies are coupled to each other or can be coupled to each other by means of at least one separate connection. By a separate connection, any form of connection is meant that differs from a connection obtained by mechanical parts manufactured from the basic material of the basic bodies. Finishing profiles according to the seventeenth aspect offer, amongst others, the advantage that the connection among the basic bodies is no longer depending directly on the basic bodies themselves, but on the separate connection, whereby, as a result, more simple forms can be applied for the basic bodies. The separate connection preferably consists of an adhesive connection, for example, a glue connection or adhesive tape connection, and/or a connection by means of a layer-shaped covering extending over both basic bodies.

According to each aspect, various other preferred forms of embodiment of the invention are possible. To this aim, reference is made to the detailed description and appended claims.

The invention also relates to all possible combinations of the characteristics of the various aforementioned aspects, such, of course, inasmuch as such characteristics are compatible with each other.

With the intention of better showing the characteristics of the invention, hereafter, as an example without any limitative character, several preferred forms of embodiment are described, with reference to the accompanying drawings, wherein.

Figure 18:
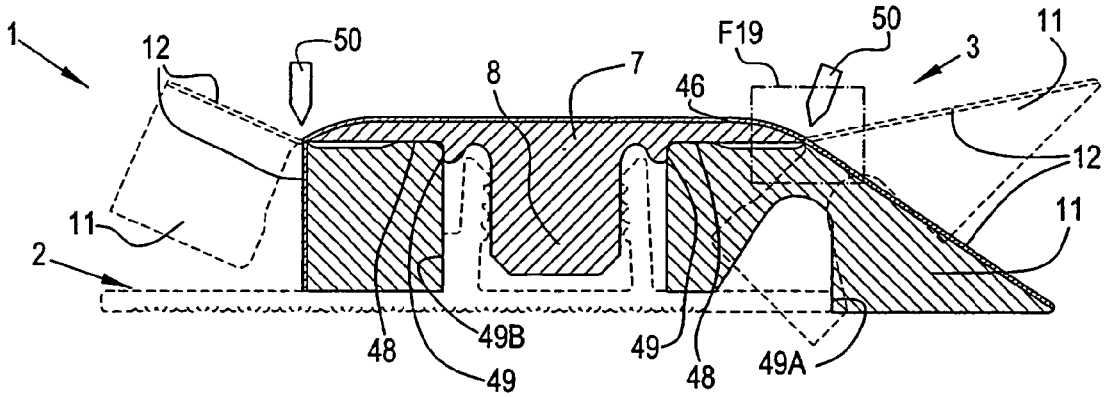
FIG. 18 represents another finishing profile according to the invention.
Figure 19:
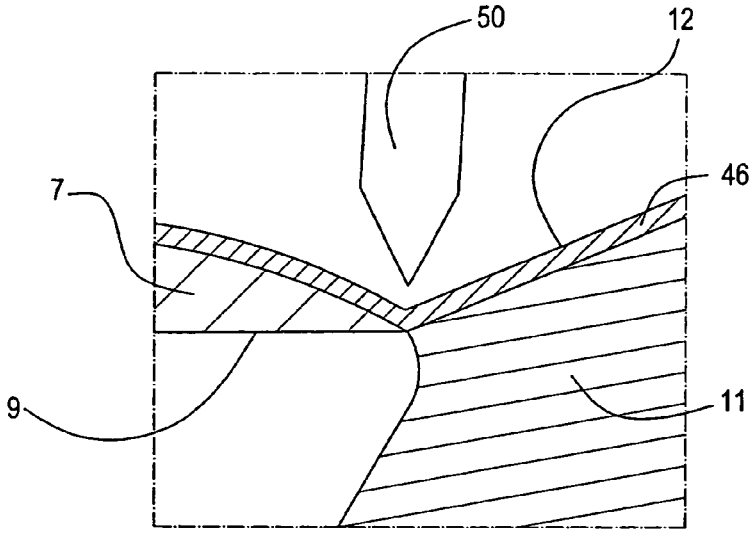
Figure 20:
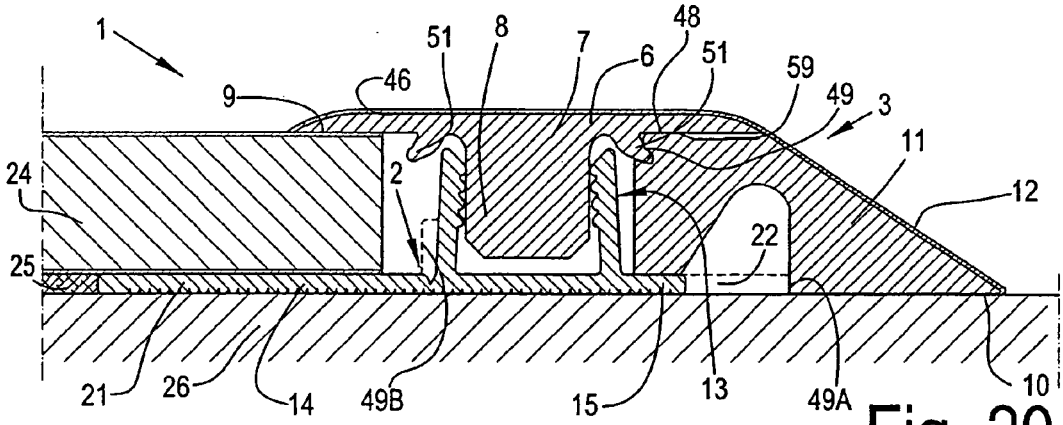
Figure 21:
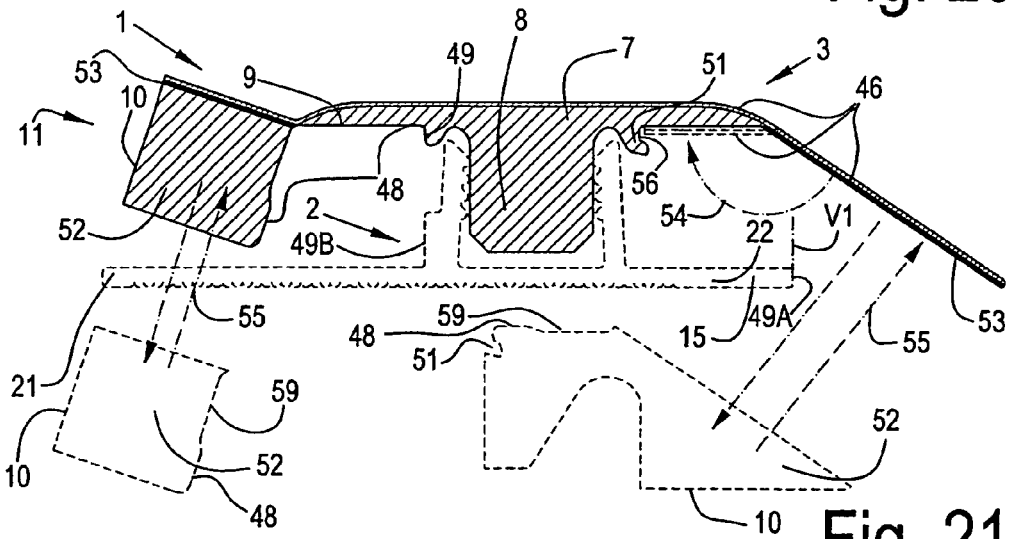
Figure 22:
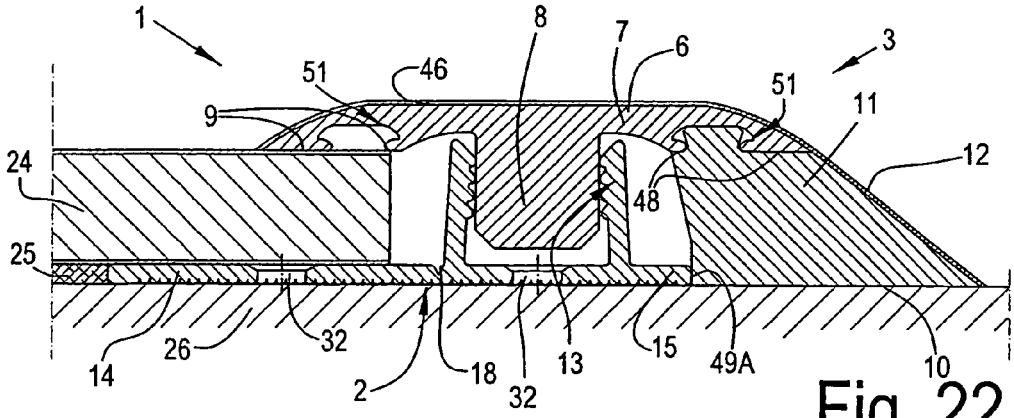
Figure 23:
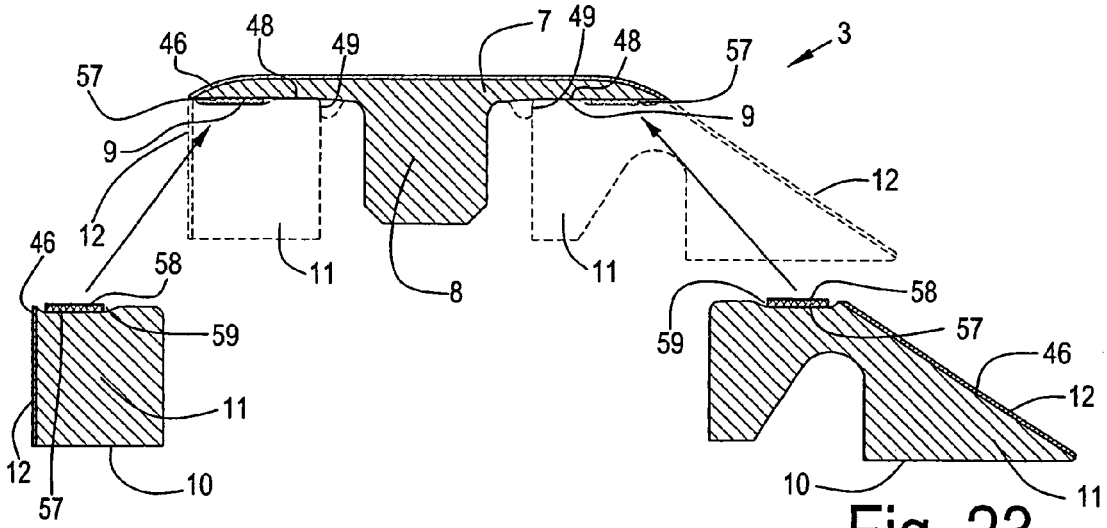
Figure 24:
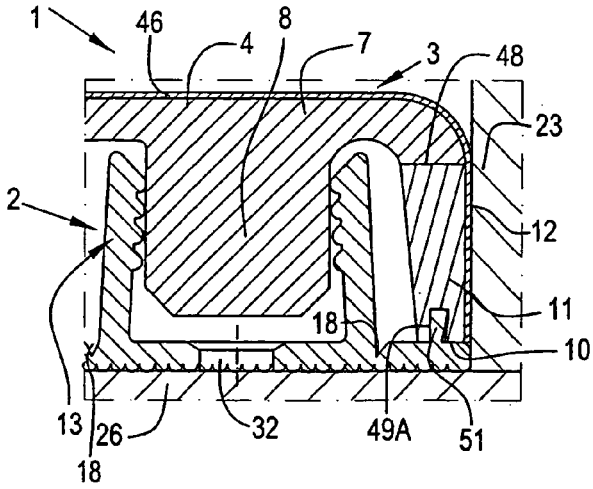
Figure 25:
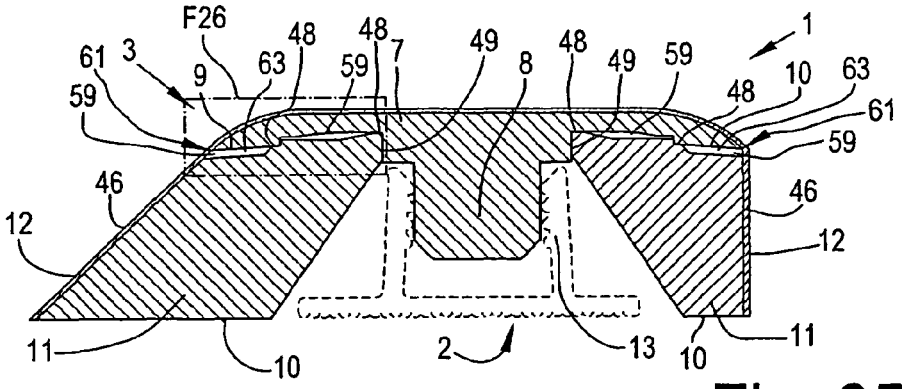
Figure 28:
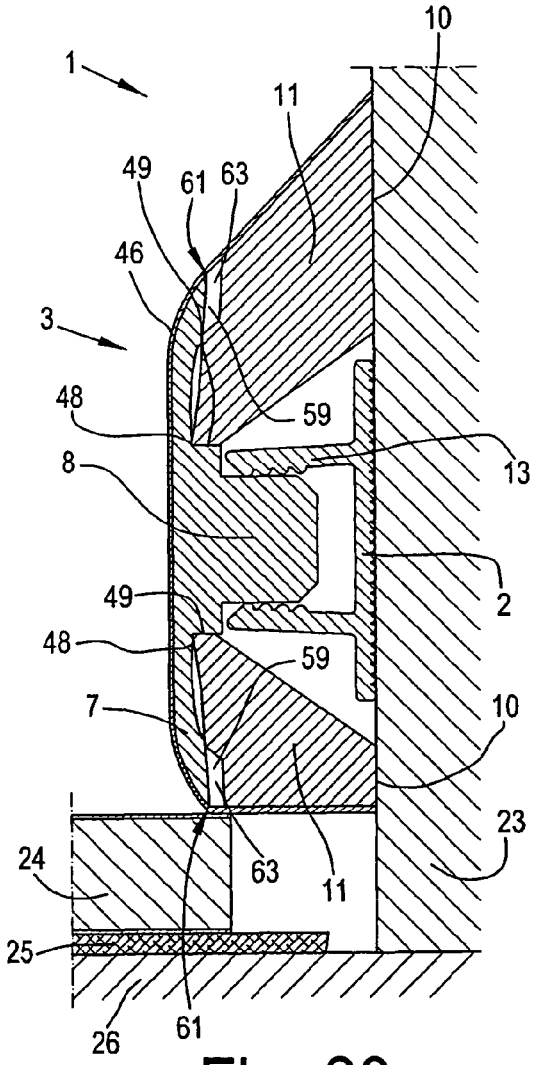
Figure 29:
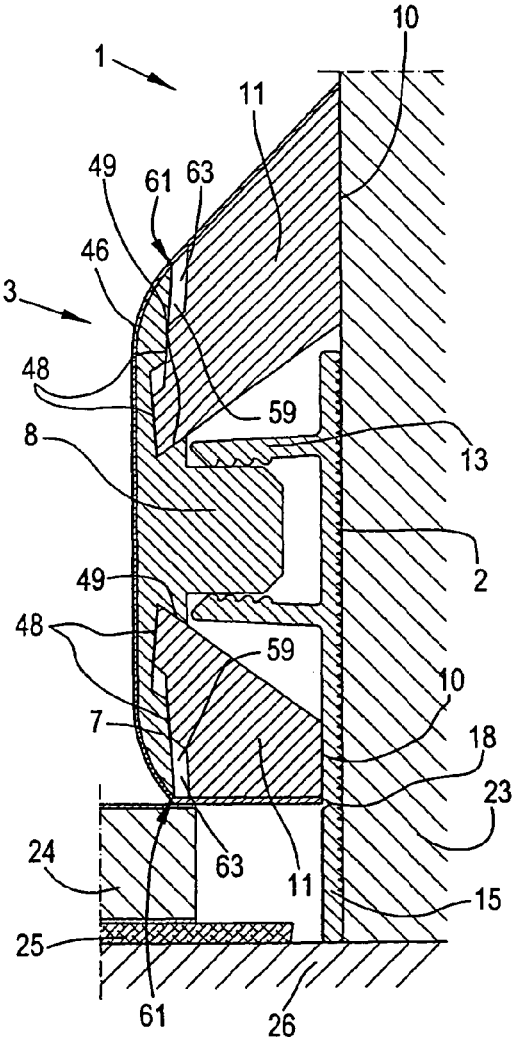
Figure 26:
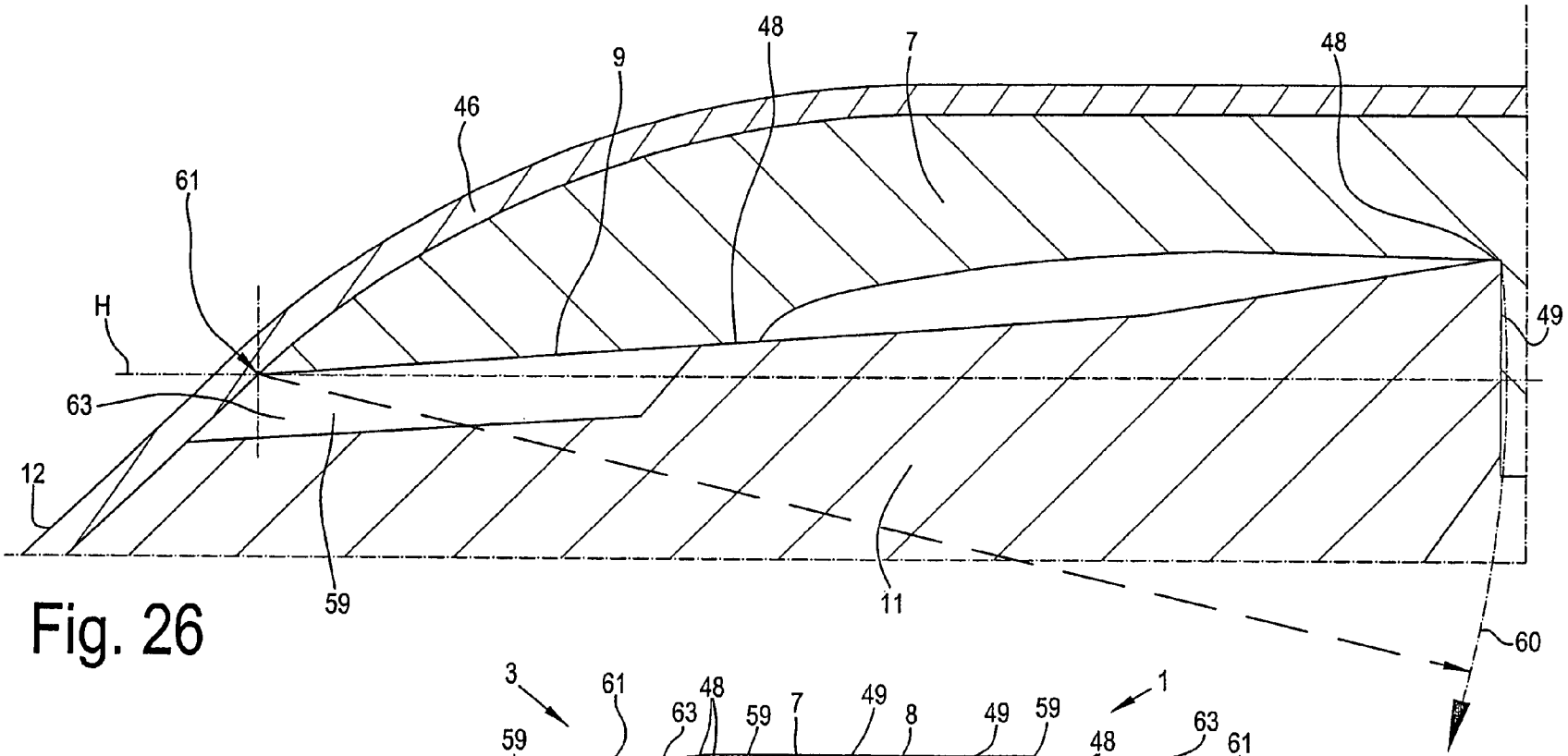
Figure 27:
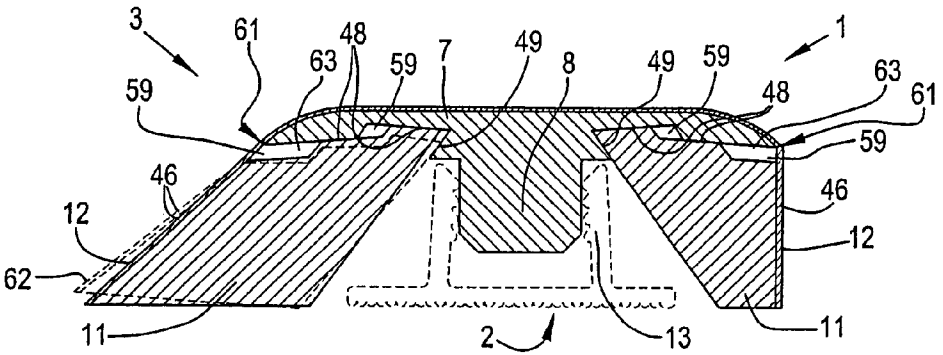
Figure 30:
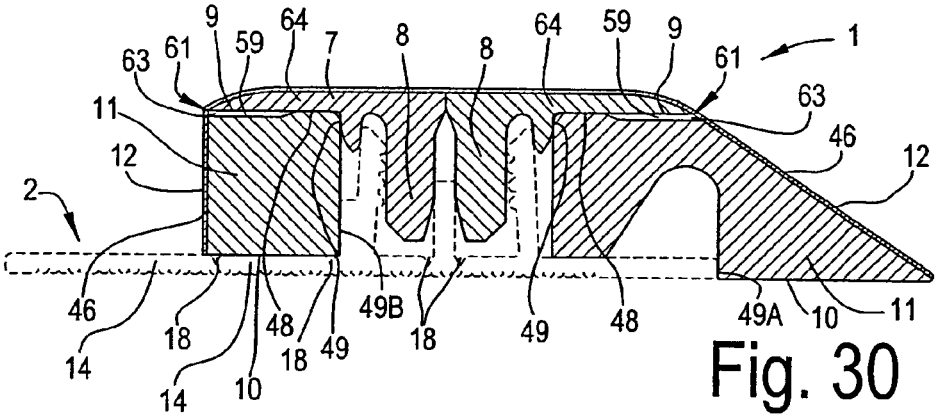
Figure 31:
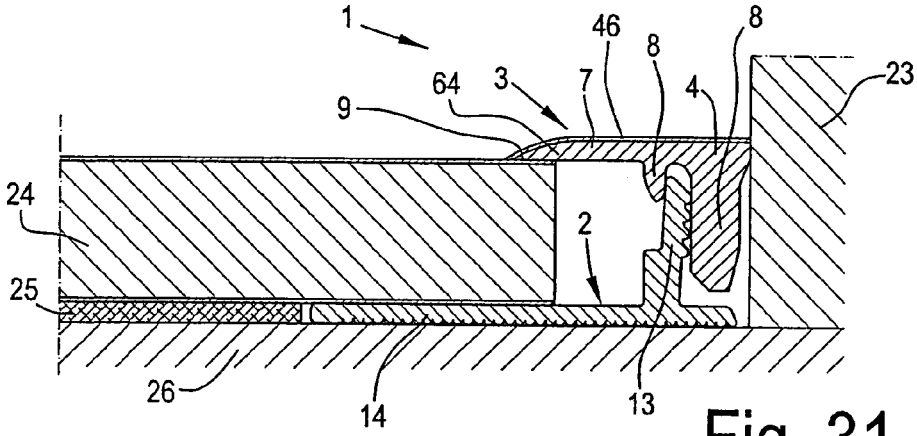
Figure 32:
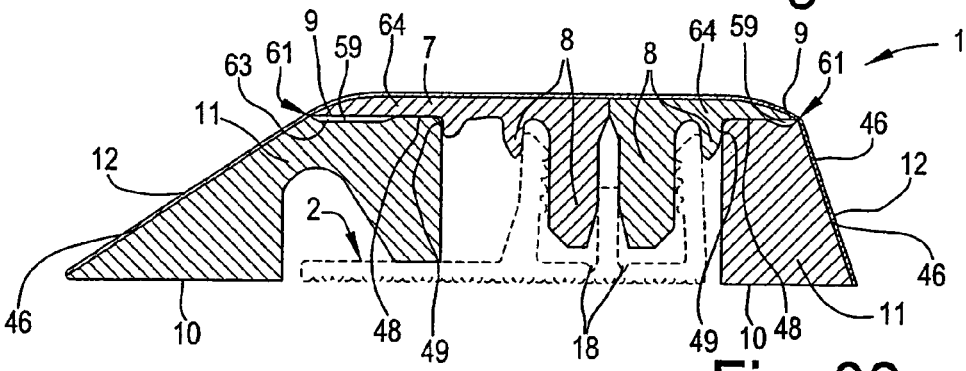
Figure 33:
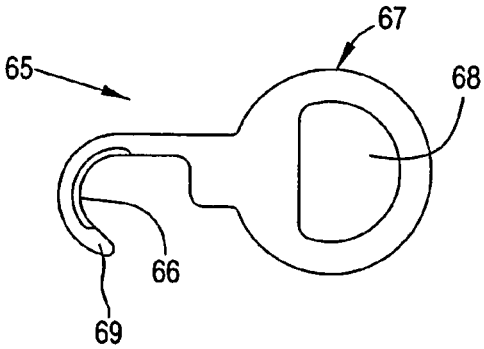
Figure 34:
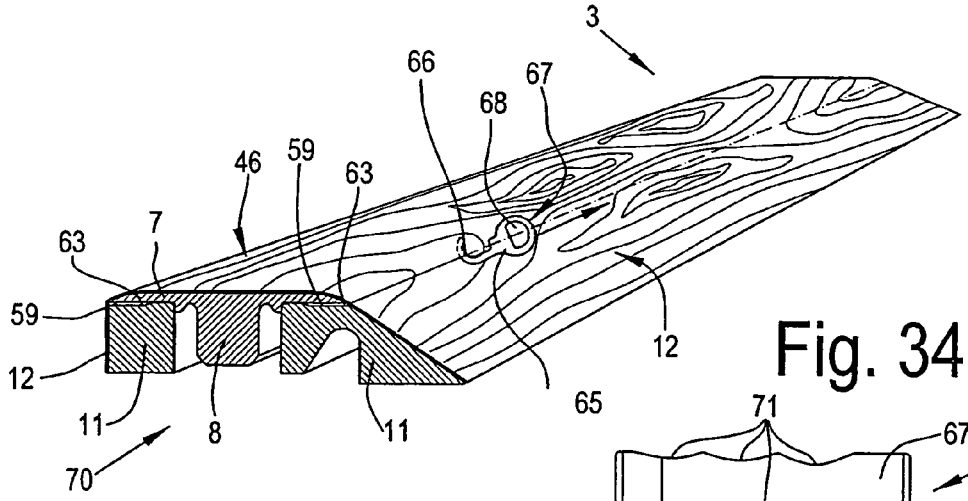
Figure 35:
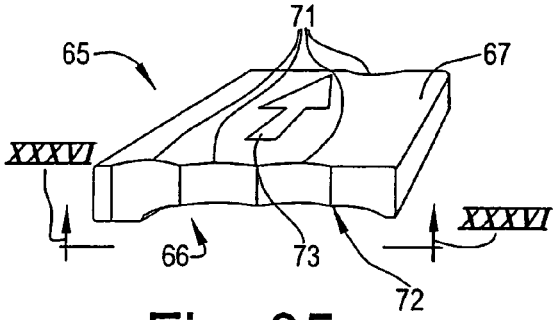
Figure 36:
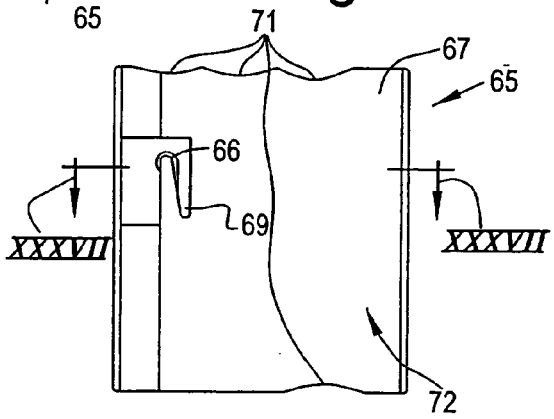
Figure 37:
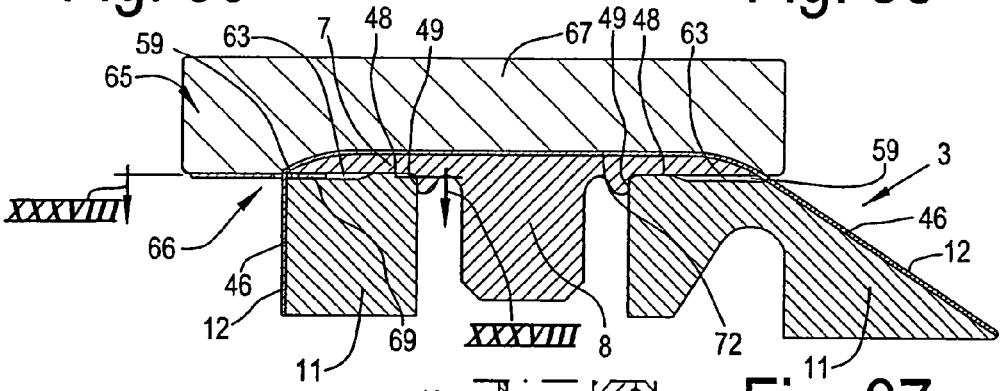
Figure 38:
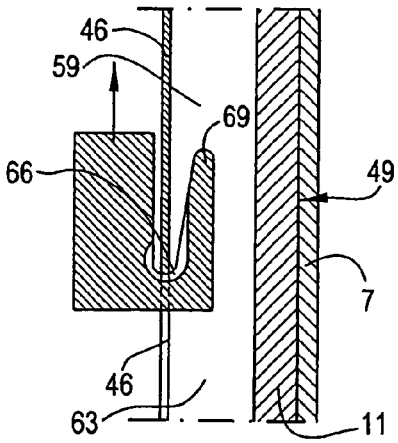
Figure 39:
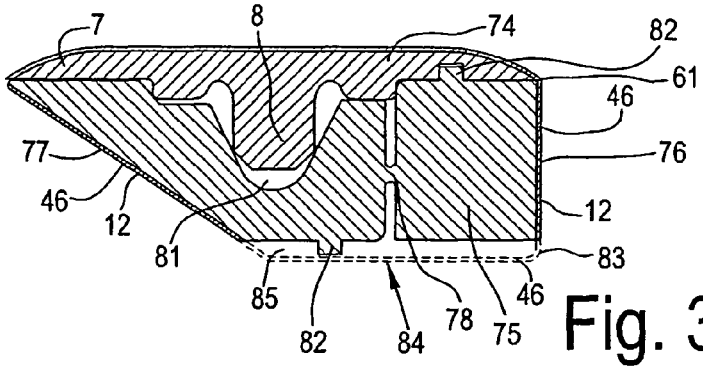
Figure 40:
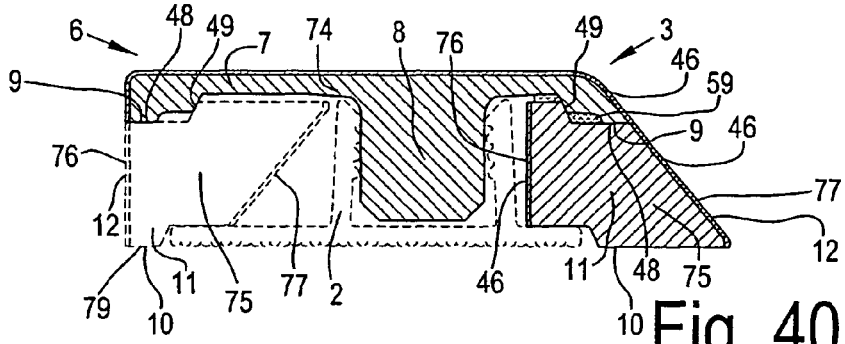
Figure 41:
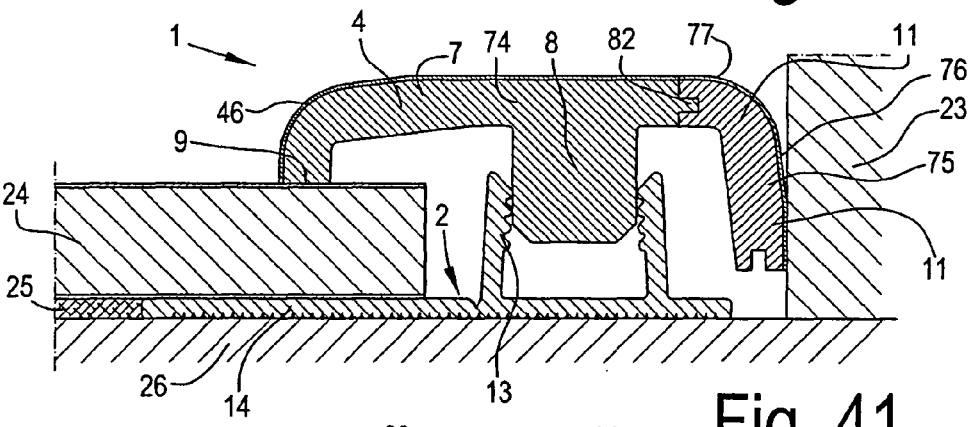
Figure 42:
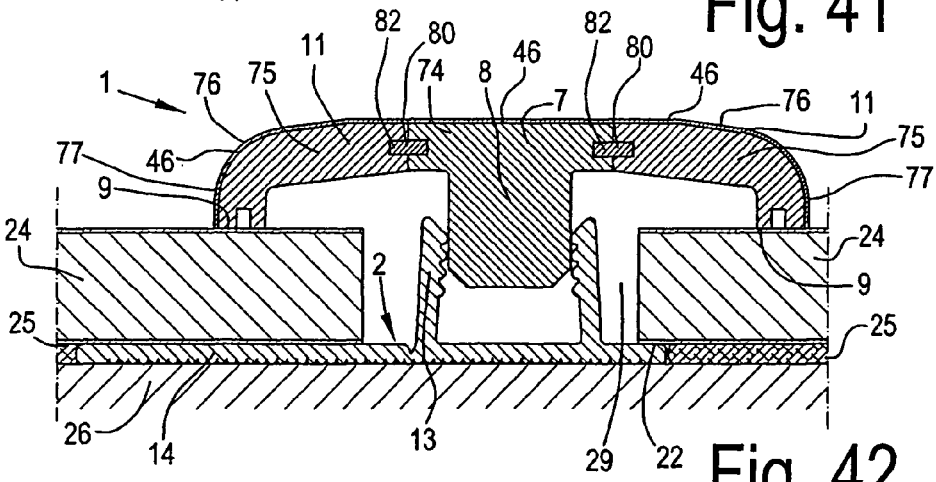
Figure 43:
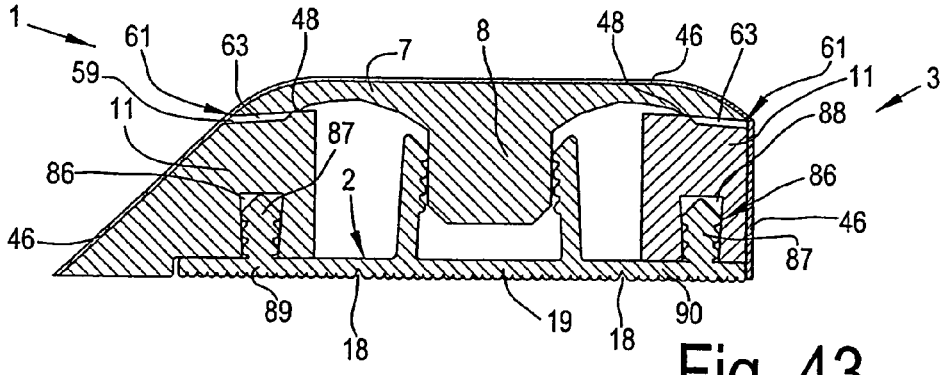
Figure 44:
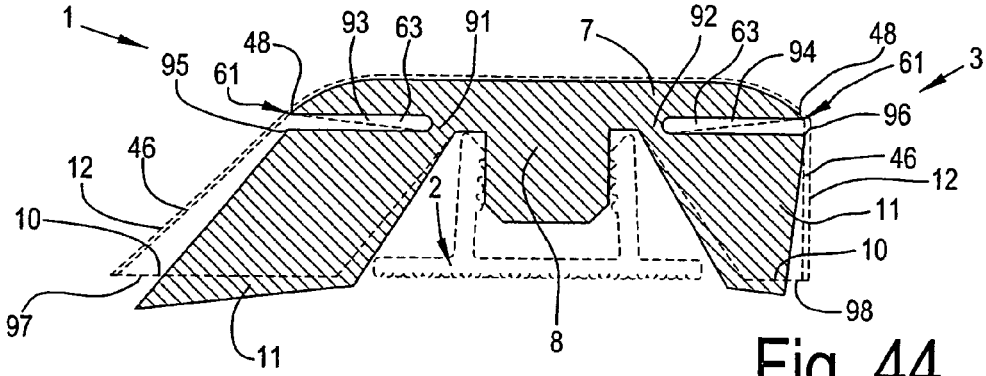
Figure 45:
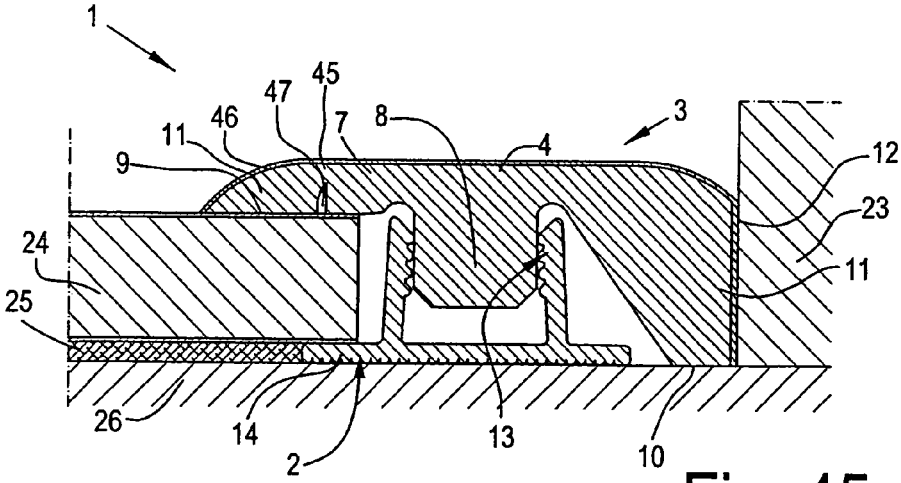
Figure 46:
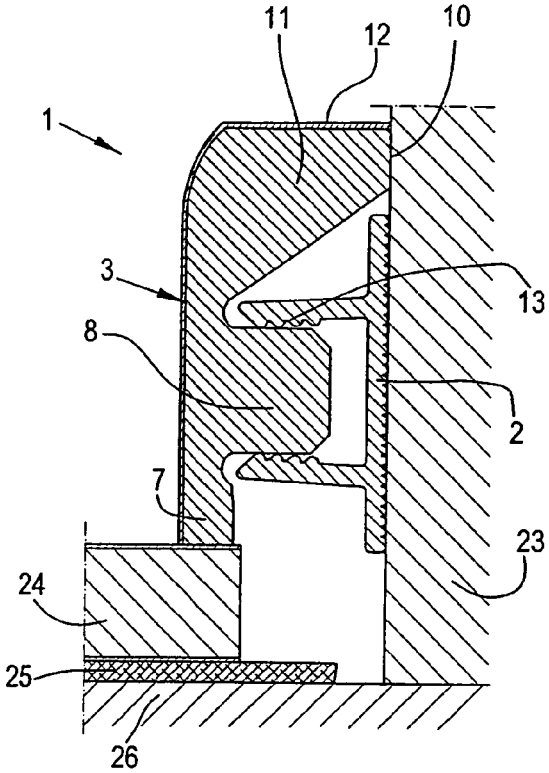
Figure 47:
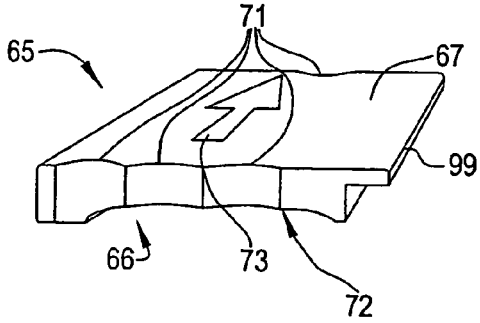
Figure 48:
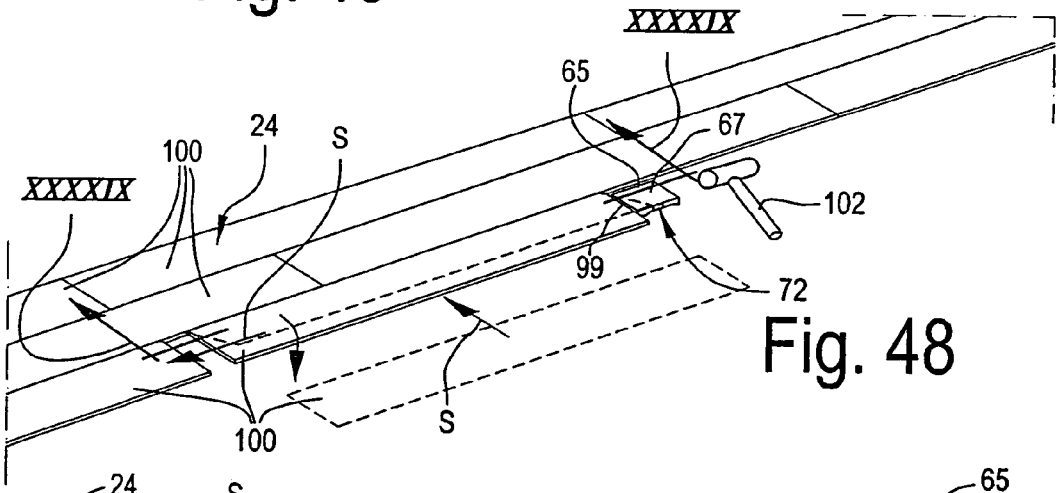
Figure 49:
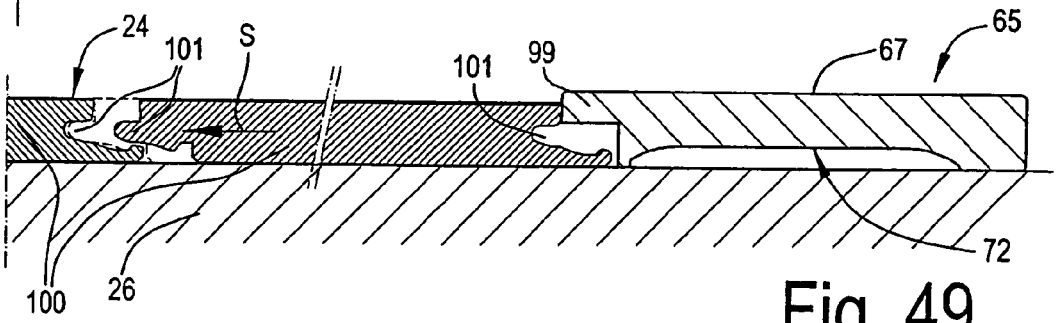
Figure 50:
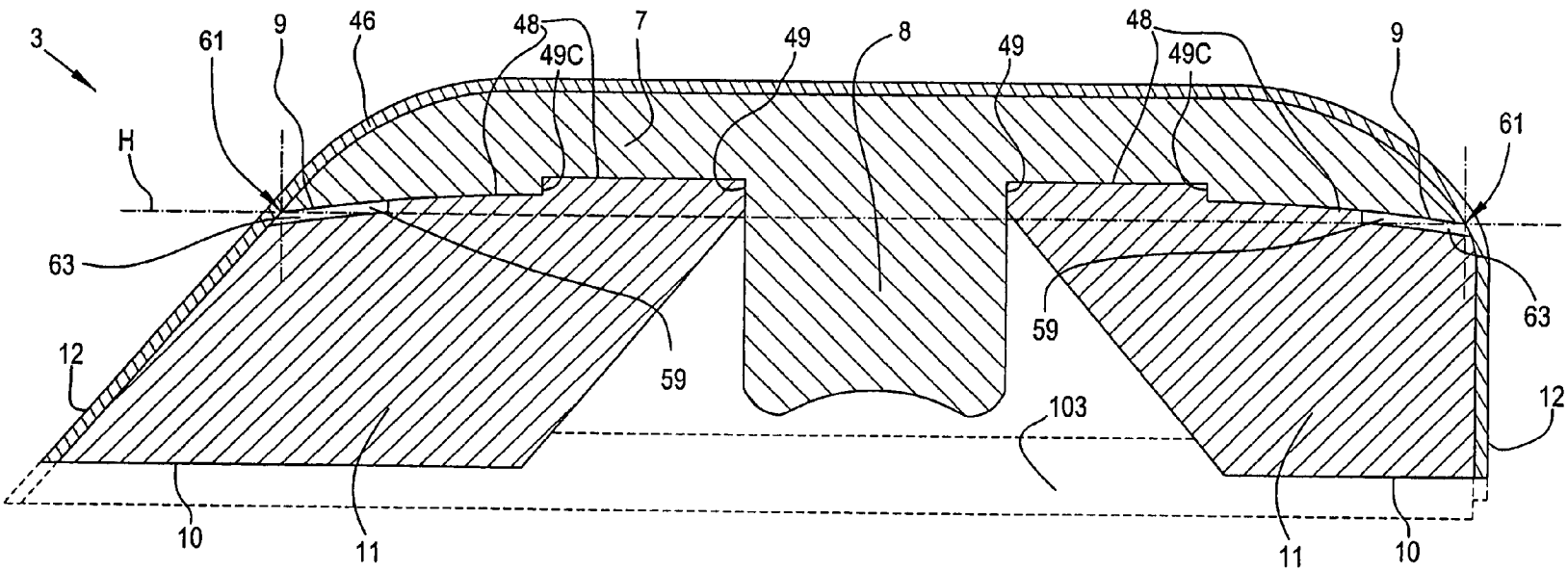
Figure 56:
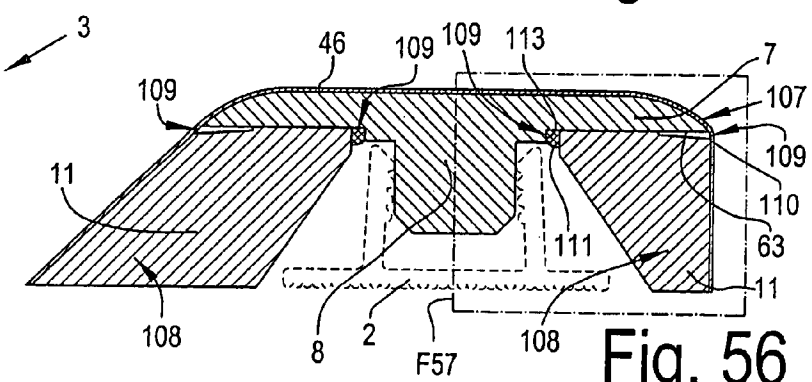

FIG. 19, at a larger scale, represents the portion indicated by F19 in FIG. 18;

FIG. 20 shows an application of the finishing profile of FIG. 18;

FIGS. 21 to 23 show variants of a finishing profile according to the invention;

FIGS. 24 and 25 show further variants of a finishing set according to the invention;

FIG. 26, at a larger scale, represents the area indicated by F26 in FIG. 25, for a slightly deviating variant;

FIG. 27 represents another variant of a finishing profile according to the invention;

FIGS. 28 and 29 represent applications of finishing sets according to the invention;

FIGS. 30 to 32 represent further variants of finishing sets according to the invention;

FIG. 33 represents an accessory that can be applied when installing a finishing profile according to the invention;

FIG. 34 represents how the accessory of FIG. 33 is applied;

FIG. 35 represents a variant of the accessory of FIG. 33;

FIGS. 36 to 38 represent views and/or cross-sections according to lines XXXVI-XXXVI in FIG. 35, XXXVII-XXXVII in FIG. 36 and XXXVIII-XXXVIII in FIG. 37;

FIG. 39 shows a set of components for forming a finishing profile with the characteristics of, amongst others, the eleventh aspect of the present invention;

FIGS. 40 to 42 show different forms of embodiment of a finishing profile with, amongst others, the characteristics of the eleventh aspect of the present invention;

FIGS. 43 and 44 show another two variants of the invention;

FIGS. 45 and 46 represent another variant of the invention;

FIGS. 47 and 48 represent a variant of the accessory of FIG. 35, with a possible application thereof;

FIG. 49 represents a cross-section according to line XXXXIX-XXXXIX in FIG. 48;

FIG. 50 represents another finishing profile according to the invention;

FIGS. 51 to 55 represent another particular technique of the invention for realizing finishing profiles;

FIG. 56 represents another variant of the invention, which, amongst others, corresponds to the seventeenth aspect;

FIGS. 57 to 62, at a larger scale, represent different variants of the portion indicated by F57 in FIG. 56.

Figure 1:
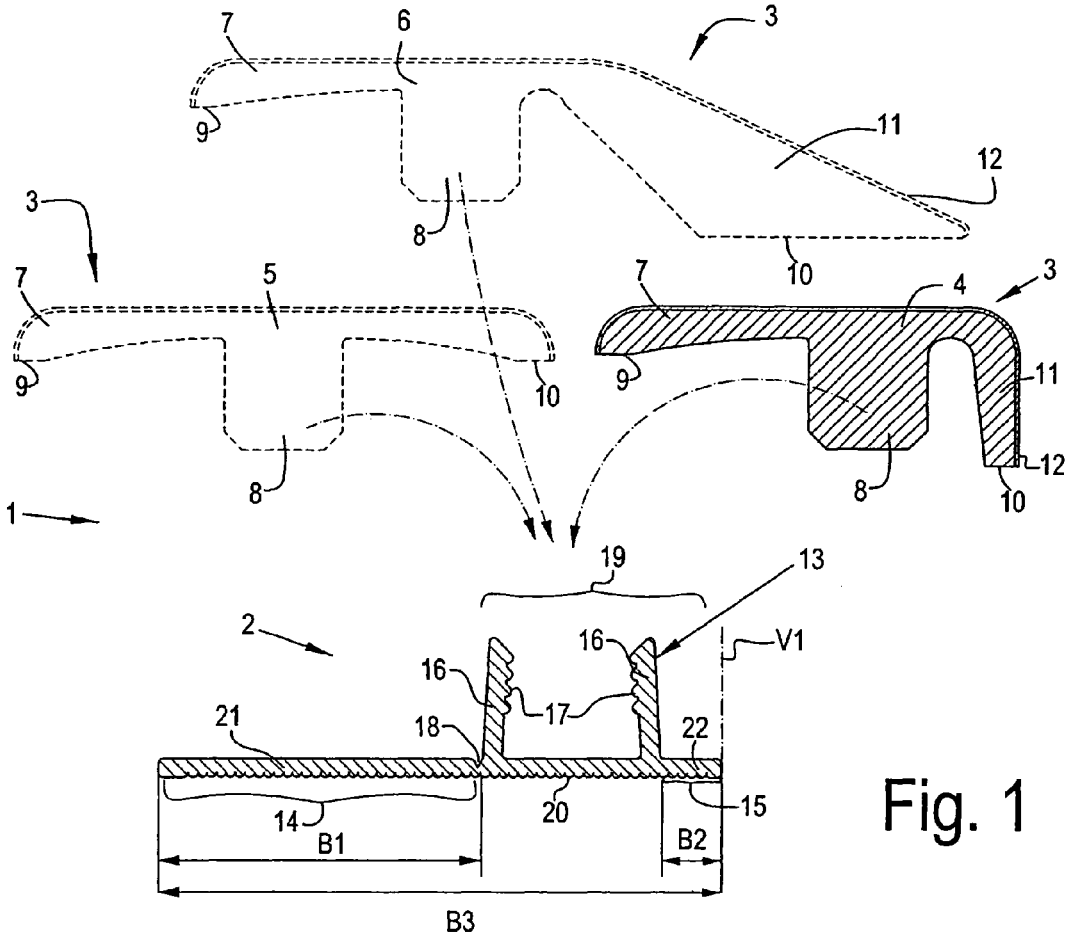
FIG. 1 represents a holder according to the invention, together with various finishing profiles.

FIG. 1 in cross-section represents the components of a finishing set 1, which, as known, consist of a holder, generally indicated by 2, and a finishing profile, generally indicated by 3.

The figure represents three traditional forms of embodiment of the finishing profile 3. These in their turn are separately numbered and relate to an end profile 4 represented in continuous line, an expansion profile 5 and a transition profile 6, both represented in dashed line.

By "expansion profile" 5, a finishing profile 3 is meant that consists of a flange-shaped portion 7 extending at the left and right hand sides of an attachment portion 8 situated at the bottom side thereof. A finishing profile 3, which is realized as an expansion profile 5, usually has, as represented, two contact surfaces 9 and 10 located, at opposite sides of the attachment portion 8, substantially at one and the same height level. A "transition profile" 6 and an "end profile" 4, on the contrary, are finishing profiles with the contact surfaces 9 and 10 located at different height levels. To this aim, the transition profile 6 and the end profile 4, at one side of the attachment portion 8, also comprise a nose portion 11 with a downward-directed end wall 12, which, at an end profile 4, usually is steeper than at a transition profile 6. Preferably, the end wall 12 of an end profile 4, as shown, will be upright and substantially vertical, whereas the end wall 12 of a transition profile 6 preferably slopes down in an inclined manner.

Unless specifically mentioned, the finishing sets of the invention that are described in the following are not restricted to the represented finishing profiles 4, 5 and 6, nor are said finishing profiles restricted to their aforementioned application.

Further, the finishing set 1 represented in FIG. 1 is realized such that it implements the first aspect of the invention. According to this aspect, the holder 2 comprises an attachment portion 13, an underlay portion 14, as well as a stop-forming positioning portion 15.

In the represented example, the attachment portion 13, which is intended to cooperate with the attachment portion 8, consists of two legs 16, which, at the inner side, are provided with ribs 17. The legs 16 are standing somewhat inclined towards the inside. During mounting, the legs 16 clamp around the attachment portion 8 of the finishing profile 3. The ribs 17 provide for an extra solid mounting and grip. Possibly, these ribs 17 may grip barb-like into corresponding cavities of the attachment portion 8 of the finishing profile 3. Of course, other attachment portions 13 or 8 for holders 2 and finishing profiles 3 are possible, without leaving the scope of the present invention.

As represented, said underlay portion 14 preferably is realized as a small underlay strip and may be separated, according to a break-off line 18 consisting of a V-shaped section reduction, from the remaining portion 19 of the holder, either by breaking it off or tearing it off, or by means of the application of simple tools, such as a knife, with which the underlay portion 14 can be cut off. Within the scope of the invention, the means for removing the underlay portion 14 from the remaining portion 19 of the holder 2 may also consist, for example, of a tear-off line, a perforation, a weakened material part, etc. The respective portion may also be removed in other ways, for example, by providing it with means for bringing the underlay portion 14 into another position by means of an angling movement. This may be a mechanical hinge or, for example, a foldable portion forming part of the holder 2.

In FIG. 1, the aforementioned positioning portion 15 is realized as a free flange, whereby the distal end of this flange, which determines the vertical edge plane V1, forms a stop that allows for an optimum positioning, amongst others, in such a way as will be explained further by means of FIGS. 2 and 3.

At the bottom side, the represented holder 2 has a profiled portion 20 facilitating gluing onto the subfloor. However, attachment in another manner is not excluded, for example, by means of screws.

The represented holder 2 also complies with the second aspect of the invention. To this aim, this holder 2 has two free edge portions 21 and 22 situated at opposite sides of the attachment portion 13, whereby the widths B1 and B2 of both edge portions, each time measured from the attachment portion 13 up to the distal end of the respective edge portion 21, 22, respectively, differ from each other. More particularly, the width B1 of the free edge portion 21, which here functions as an underlay portion 14, is larger than the width B2 of the other edge portion 22, which, in this example, serves as the positioning portion 15. As represented, B1 preferably also is larger than or equal to one-half of the entire width B3 of the holder 2, such that, when applying the edge portion 21 as an underlay portion, a good support for the remaining portion 19 of the holder 2 by the underlay portion 14 is guaranteed, as will become clear from FIGS. 3 and 5.

Figure 2:
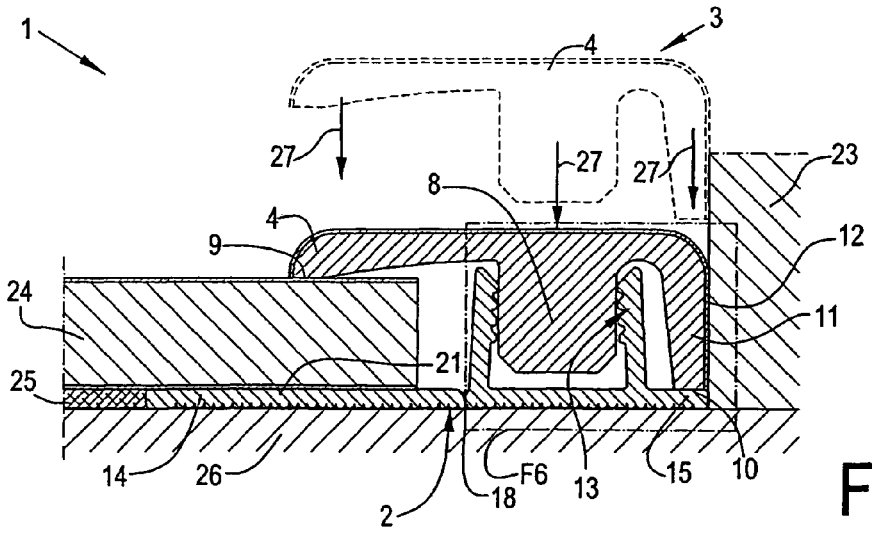
FIGS. 2 to 5 show different forms of embodiment in mounted position, whereby use is made of the holder and a finishing profile of FIG. 1.

FIG. 2 represents the finishing set 1 of FIG. 1 in mounted condition, for the case in which the holder 2 is combined with the end profile 4. Here, the finishing of a floating floor covering 24 installed on an underlayment 25 next to a wall 23 is concerned. In this case, mounting takes place, for example, by cutting off the underlayment 25 at a distance from the wall 23, putting the holder 2 on the subfloor 26 and positioning it by means of the positioning portion 15 against the wall 23, installing the floor covering 24 over the free edge portion 21 and finally fixing the end profile 4 in the attachment portion 13 of the holder 2, as indicated by arrows 27. During mounting, the holder 2 preferably is fixedly attached on the subfloor. It is not excluded that, when mounting the finishing set 1, the underlayment 25 is not cut off and that the holder 2 is provided on top of this underlayment 25.

In the example of FIG. 2, the end profile 4 precisely adjoins with its end wall 12 against the aforementioned wall 23. Depending on the embodiment, the holder 2 whether or not pushes the end profile 4 into the direction of the wall 23, as a consequence of which a clamping of the finishing profile 4 against the wall 23 is obtained. Such clamping may be achieved, for example, in that said end wall 12 of the finishing profile 3, in freely mounted position, is situated a little bit, for example, several tenths of millimeters, beyond the vertical edge plane V1 of the stop-forming positioning portion 15 of the holder 2, or, in other words, in that the distance, measured from the attachment portion 13 of the holder up to the end wall 12 of the end profile 4, in freely mounted position is larger than said width B2. By "freely mounted position" the position is meant whereby the finishing profile 3 is attached in the holder 2, however, not yet shifted against a wall 23.

Figure 3:
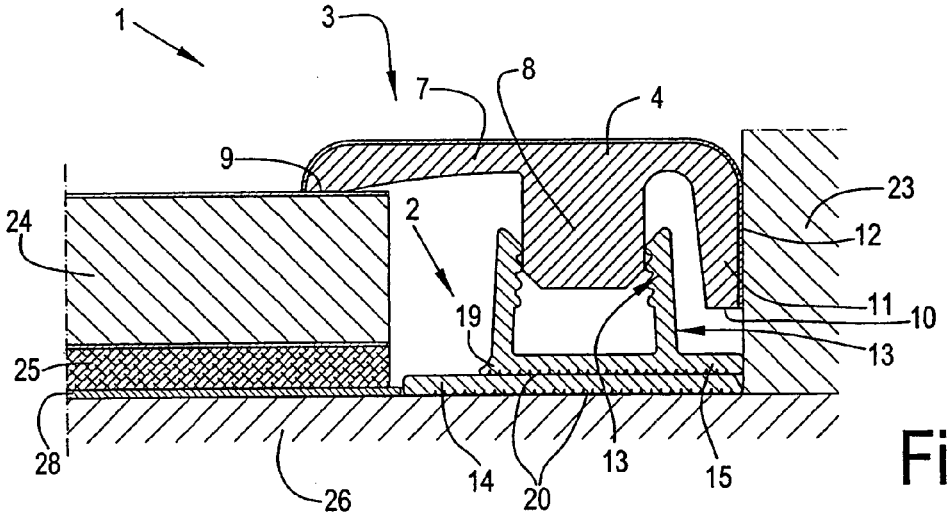

FIG. 3 shows another application of the finishing set 1 of FIG. 2. Here, the finishing of a floating floor covering 24, which is of a thicker type than the floor covering 24 of FIG. 2, next to a wall 23 is concerned. The floor covering 24 is also lying on an underlayment 25 of a thicker type than the underlayment 25 of FIG. 2; moreover, a vapor screen 28 is situated below said underlayment 25 that bars rising moisture. In order to bridge over the larger overall thickness of the various floor covering layers and thereby still be able to attach the attachment portion 8 in a sufficiently secure manner in the attachment portion 13, the underlay portion 14 has been broken off and has been put underneath the remaining portion 19. Hereby, the underlay portion 14 and the portion 19 can be held at their place in any manner, for example, by means of glue or attachment elements, such as screws, with which both parts are held on the subfloor. To this aim, screw holes possibly may be provided in the underlay portion and/or the portion 19.

Figure 4:
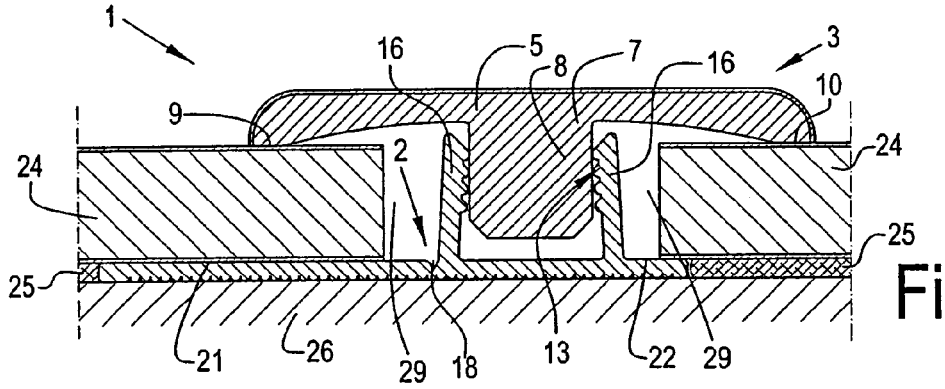

FIG. 4 shows still another application of the finishing set 1 of FIG. 1, whereby the holder 2 is combined with the expansion profile 5. Here, the finishing of, for example, an expansion joint 29 in a floating floor covering 24 is concerned. The mounting of the whole can simply be deduced from the figure. It is not excluded that, when using the respective finishing set 1, the underlayment 25 is not interrupted and the holder 2 simply is fixed on the underlayment 25. Also, the user can decide, depending on the width of the expansion joint 29 to be finished and the type of floor covering 24, whether he will install both, one or none of the edge portions 21 and 22 underneath the floor covering 24. The holder shown here even allows to remove the widest free edge portion 21 in order to allow an even larger finishing flexibility. According to a not-represented variant, also the narrowest free edge portion 22 may be removable from its position, either by separating it, or by angling it into another position.

Figure 5:
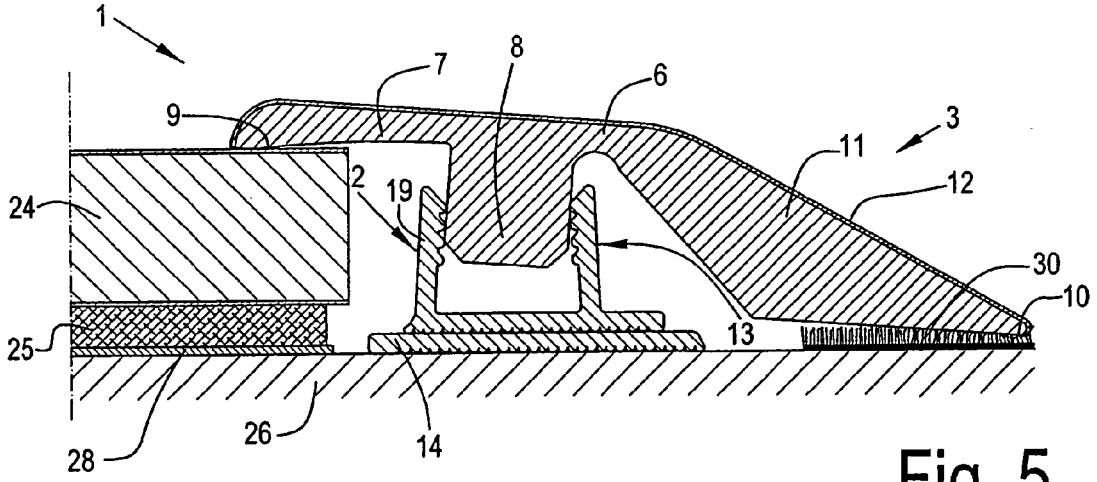

FIG. 5 shows an example of the use of the finishing set 1 of FIG. 1, in the case that the holder 2 is combined with the transition profile 6. Here, the finishing of a transition from a floating floor covering 24 of the same type as in FIG. 3 to a fitted carpet 30 is concerned. The mounting takes place in a manner similar to that in FIG. 3. In this case, the transition profile 6 is slightly inclined by clamping it with its attachment portion 8 obliquely into the attachment portion 13 of the holder 2.

Figure 6:
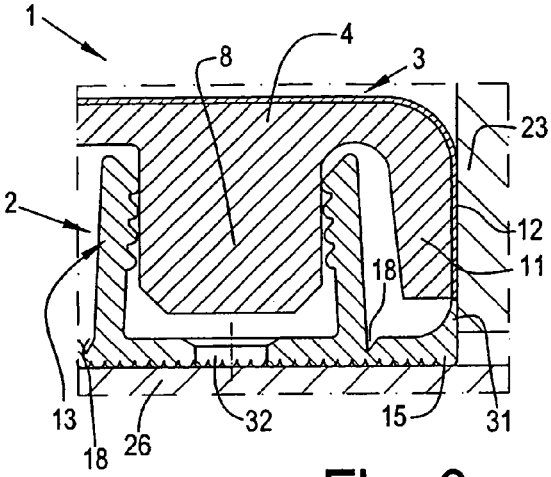
FIGS. 6 to 10 represent an enlarged view of the portion indicated by F6 in FIG. 2, and this for different variants of the invention.

FIG. 6 shows an application of a variant of the finishing set 1 of FIG. 1. The stop-forming positioning portion 15 of the holder 2 is realized with an upwardly directed portion 31. This prevents that, when finishing a floor covering 24 next to a wall 23 or other upwardly directed portion, which does not adjoin the subfloor 26, the positioning portion 15 slips under the wall 23 and therefore causes a faulty positioning of the holder 2 in respect to the wall 23. The positioning portion 15 is also realized separable by means of a break-off line 8. For attaching the holder 2, in this example screw holes 32 are provided.

Figure 7:
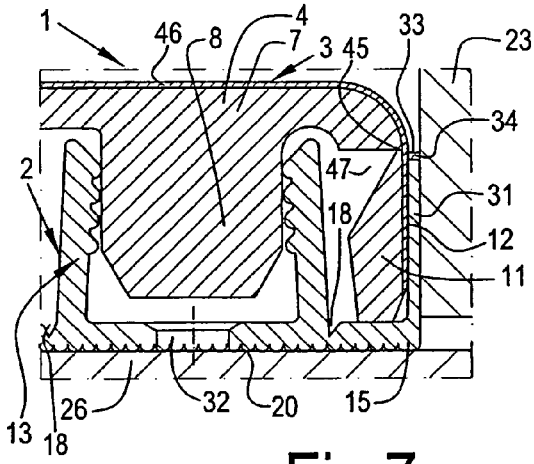

FIG. 7 shows the application of another variant of the finishing set 1 of FIG. 1. Here, again the finishing of a floor covering against a wall 23 is concerned. In this case, too, the stop-forming positioning portion 15 of the holder 2 consists of an upwardly directed portion 31. In this application, the upwardly directed portion 31 forms a visible border 33 against the wall. This border 33 may possibly be covered with a covering 34, whether or not matching the floor covering 24 or the finishing profile 3. When utilizing this holder 2, also a clamping, as described in respect to FIG. 2, may be obtained. Now, a clamping of the end wall 12 of the finishing profile against the upwardly directed portion 31 of the holder 2, and/or of the upwardly directed portion 31 against the wall 23 is concerned.

Figure 8:
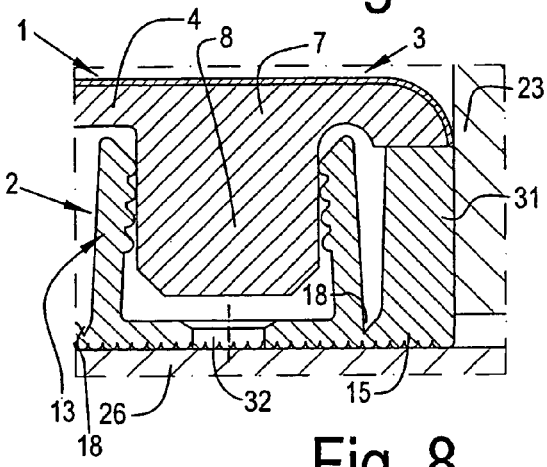

FIG. 8 represents the application of still another variant of the finishing set 1 of FIG. 1. In this case, the finishing profile 3 is realized as an expansion profile 5, however, applied as an end profile 4. To this aim, the upwardly directed portion 31 of the holder 2, which serves as a positioning portion 15, supports the expansion profile 5.

Figure 9:
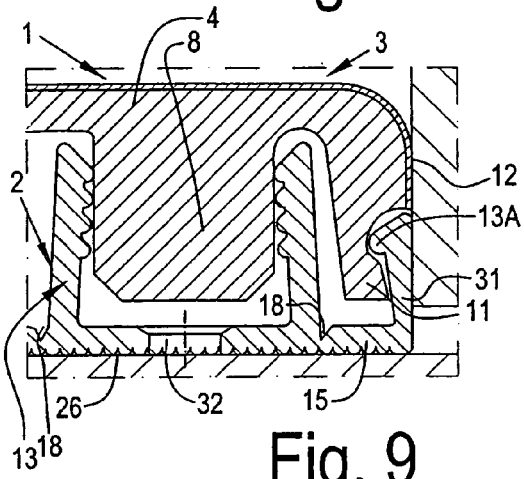

In FIG. 9, the upwardly directed portion 31 of the stop-forming positioning portion 15 also forms an additional attachment portion 13A for attaching the utilized finishing profile 3 on the holder 2.

Figure 10:
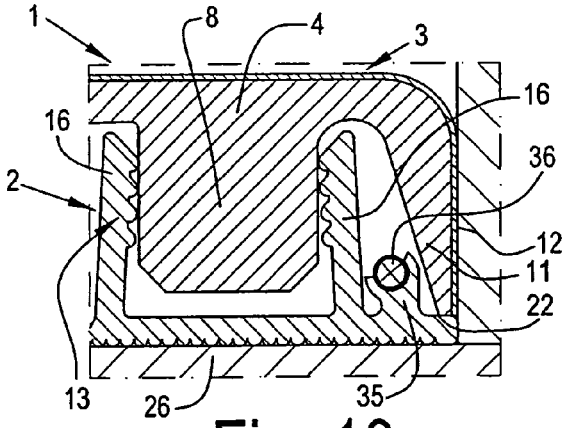

In FIG. 10, another attachment portion 35, which is used for other purposes than fixing a finishing profile 3, is situated on the holder 2, in this case, on the edge portion 22. In the example given here, an attachment portion 35 for an electric conduit 36 is concerned. Without leaving the scope of the invention, other functional portions may be situated on the holder 2, which independently also forms an inventive idea.

Figure 11:
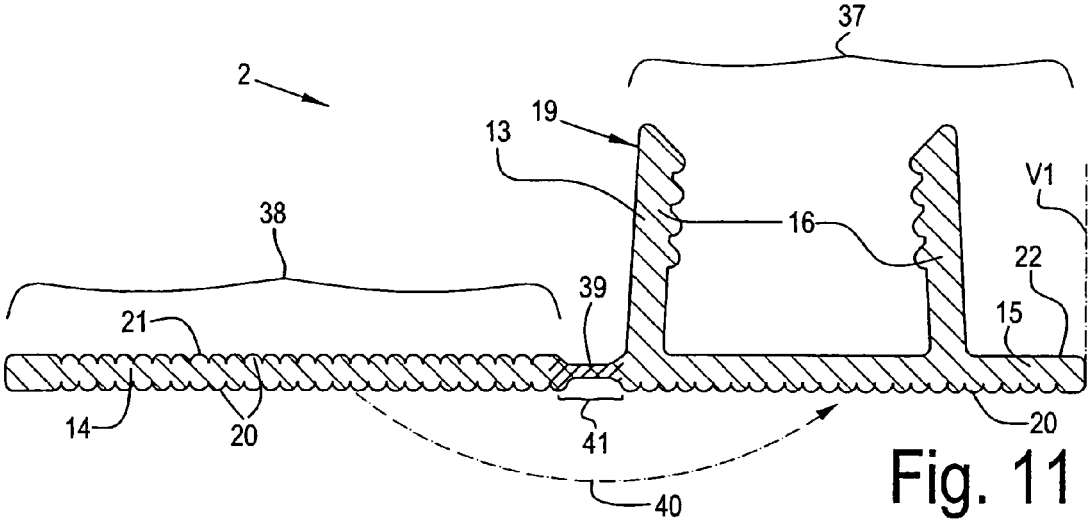
FIG. 11 represents a holder according to the invention.

FIG. 11 shows a holder 2 for attaching a finishing profile 3 according to the third aspect of the invention. To this aim, the holder 2 comprises a first portion 37 with an attachment portion 13 for attaching a finishing profile 3 on the holder 2, as well as a second portion 38 with a function that differs from the aforementioned attachment portion 13. In this example, this second portion 38 is an underlay portion 14 and is hingeably connected to the first portion 37. The underlay portion 14 is realized as a laterally extending flange, which can be folded by means of the hinge 39, according to the represented arrow 40, between a position in which it extends laterally, and a position in which it is situated underneath the portion 37.

The hinge 39 of the represented form of embodiment is a foldable material portion 41, which is manufactured by co-extrusion together with the first portion 37 and the second portion 38 of the holder 2. The foldable portion 41 consists of a more flexible material than the first portion 37 and the second portion 38 of the holder 2. The invention does not exclude that the holder 2 comprises a hinge 39 that is designed in another manner. For example, the hinge 39 may consist of a weakened material part or a mechanical hinge; also, the whole holder 2 may consist of a deformable material, such that the user may fold the holder 2 as desired.

The underlay portion 14 of the holder 2 of FIG. 11 comprises a profiled part 20 on both sides, such that gluing of the holder 2 onto the subfloor is easy for any application.

Figure 12:
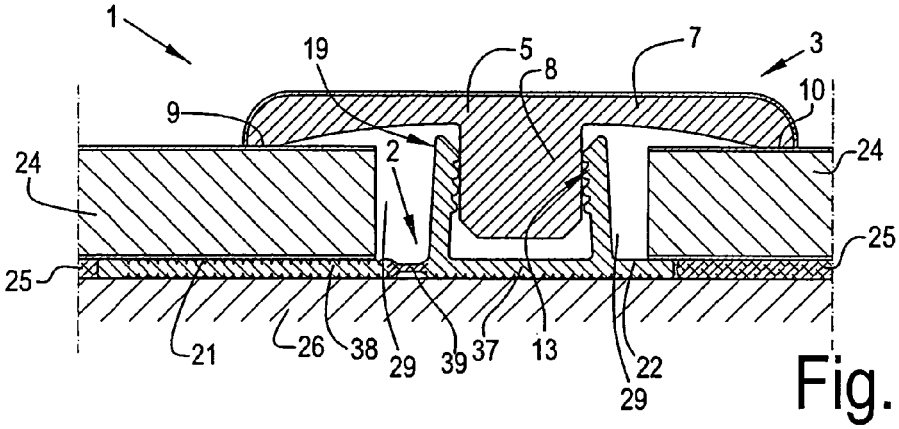
FIGS. 12 to 13 represent the holder of FIG. 11 in different applications.

FIG. 12 shows an application of the holder 2 of FIG. 11. Here, the finishing of an expansion joint 29 by means of an expansion profile 5 is concerned. Here, the hingeable second portion 38 is represented in its first operational position, whereby it is pushed under the floor covering 24. It must be noted that the attachment of the holder 2 on the underlayment 25, by pushing the underlay portion 14 under the floor covering 24, may be insufficient, as the attachment portion 13 is connected to the underlay portion 14 by means of the foldable co-extruded material 41. Thus, it is recommended to glue the holder onto the subfloor 26 or to screw it thereon.

Figure 13:
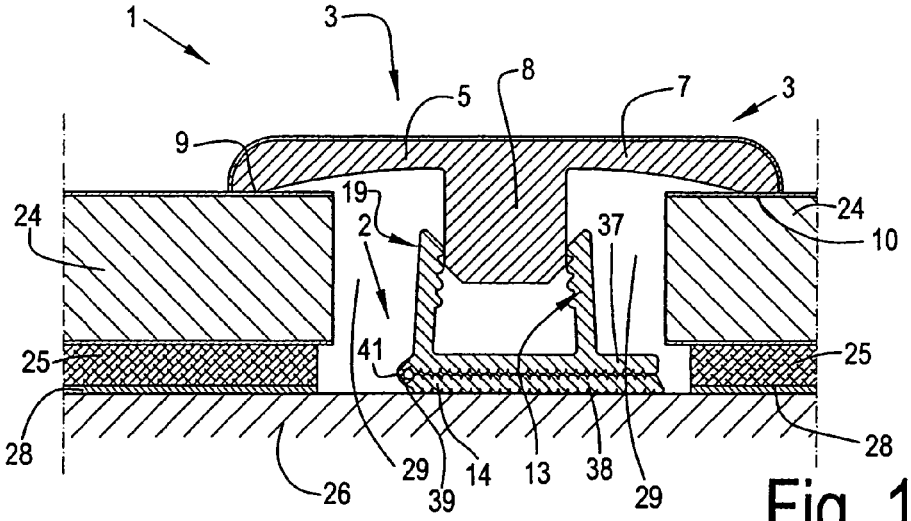

FIG. 13 shows another application of the holder 2 of FIG. 11. Here, the finishing of an expansion joint 29 between a floor covering 24 and an underlayment 25, which together form a thicker covering than is represented in FIG. 12, is concerned. In order to allow the finishing, the second portion 38 then is put into its second operational position, whereby it is pivoted underneath the first portion 38 and thereby functions as an underlay portion.

Other, whether or not operational, positions of the hingeable second portion 38 of the holder 2 are possible, without leaving the scope of the invention.

Figure 14:
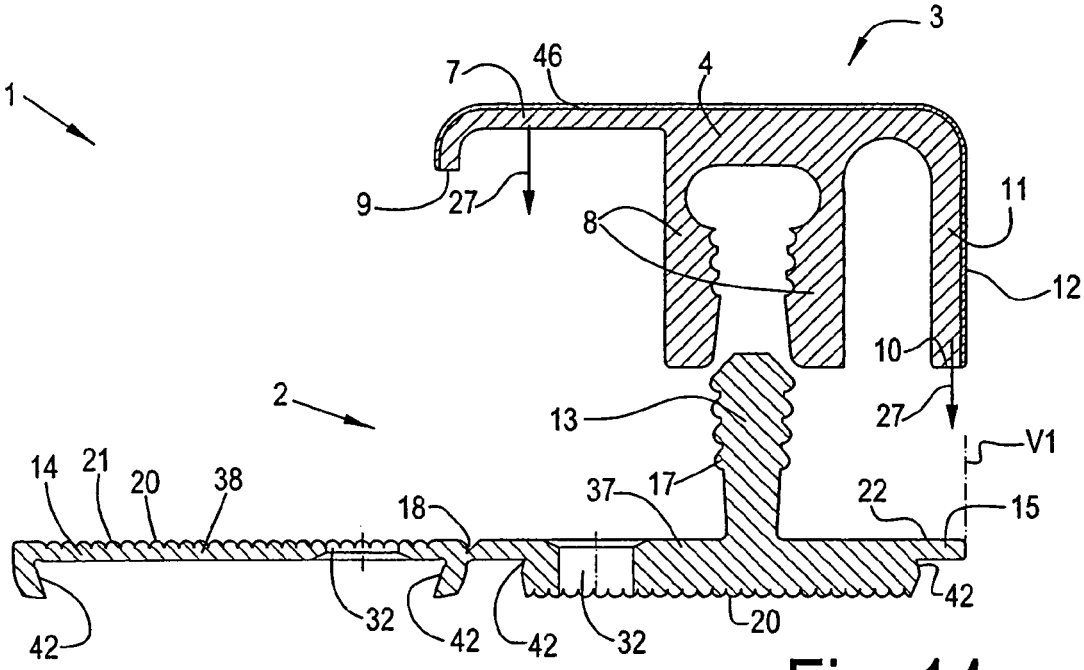
FIG. 14 represents a variant of a finishing set according to the invention.

FIG. 14 shows a holder 2 for attaching a finishing profile 3, which is realized according to the fourth aspect of the invention. Here, a holder 2 is concerned consisting of a first portion 37 with an attachment portion 13 for attaching a finishing profile 3 on the holder 2, as well as of a second portion 38, in this case realized in one piece with the first portion 37, which second portion can be utilized as an underlay portion 14 for the first portion 37. The attachment portion 13 of the holder 2 shown here is an example of a variant of the attachment portion 13 of the holder 2 represented in FIG. 1.

Moreover, the holder 2 of FIG. 14 is provided with mechanical positioning means, such as meant in the fourth aspect of the invention, which positioning means, in this case, are realized in the form of locking means 42, which are present on the first portion 37 as well as on the second portion 38.

Figure 15:
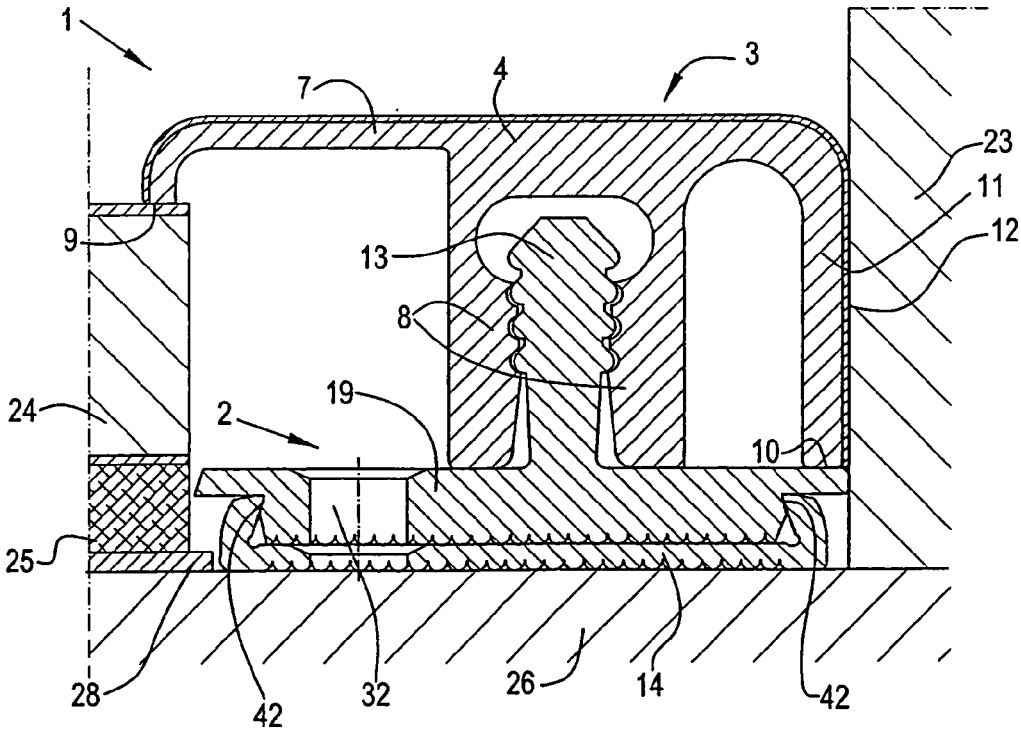
FIG. 15 represents the finishing set of FIG. 14 in mounted position.

FIG. 15 represents an application of the finishing set 1 of FIG. 14. Hereby, the second portion 38 of the holder 2 is provided as an underlay portion 14 underneath the first portion 37. FIG. 15 shows that the locking means 42 allow for that the portions 37 and 38 can be attached on top of each other by means of a snap connection, whereby then a locking in vertical direction and in transverse direction among both portions 37 and 38 is obtained.

Within the scope of the invention, and according to the fourth aspect thereof, the locking means 42 also may effect a locking in longitudinal direction. Moreover, it is possible that only positioning means are applied between the portions 37 and 38, whereby then no attachment between the portions 37 and 38 is effected, but exclusively a mutual lateral or transverse shifting is prevented. The locking or positioning means may also be realized in another manner than mechanically, such as, for example, by means of magnetic interaction.

In the portions 37 and 38, screw holes 32 are provided, the axis lines of which, in the coupled position of the first portion 37 and the second portion 38, coincide. It is clear that such screw holes 32 are on option.

Figure 16:
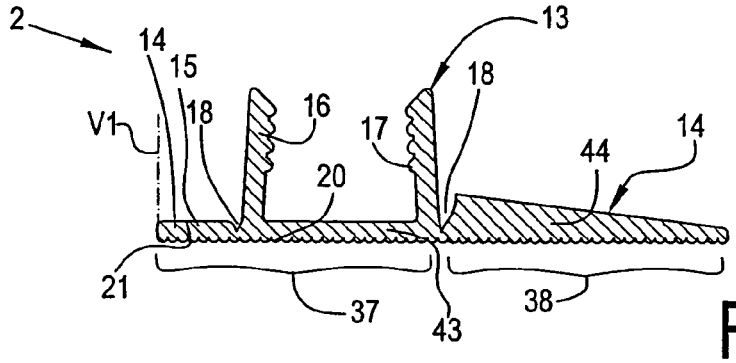
FIG. 16 represents another holder according to the invention.

FIG. 16 shows a holder 2 according to the fifth aspect of the invention. To this aim, the holder 2, on the one hand, consists of a first portion 37 with an attachment portion 13 for attaching a finishing portion 3 on the holder 2, and with a base 43, with which this first portion 37 can be attached on a subfloor, in this case, the subfloor 26, as well as, on the other hand, of a second portion 38, which, in this case, is realized in one piece with the first portion 37, said portion 38 consisting of an adjustment portion 44, with which the first portion 37 can be adjusted at an angle in respect to a subfloor, in this case the subfloor 26.

Figure 17:
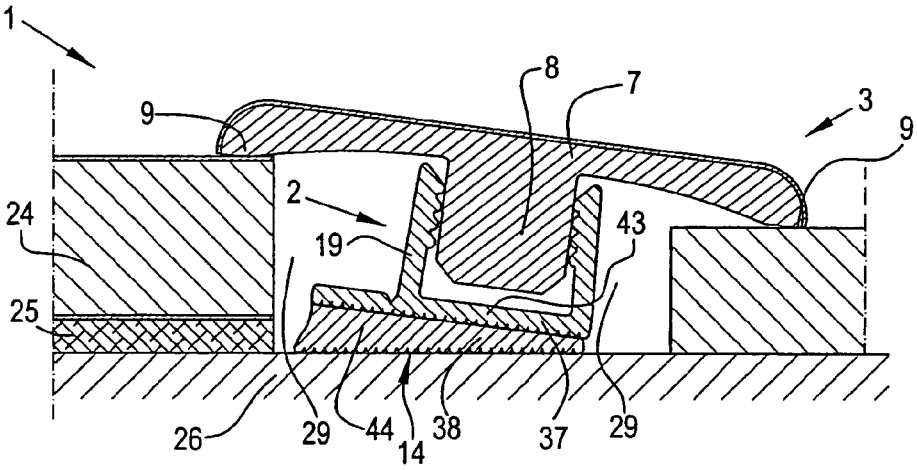
FIG. 17 represents an application of the holder of FIG. 16.

The adjustment portion 44 represented in FIG. 16 here relates to a wedge-shaped underlay portion that can be broken off, which, when applied, forces the holder 2 to take a tilted position, as represented in FIG. 17.

The adjustment portion 44 preferably allows a larger inclination of the finishing profile 3 than the one obtained by solely attaching the attachment portion 8 in the attachment portion 13 in an inclined manner, as represented in FIG. 5. Inclining the finishing profile 3 allows finishing a transition between two floor coverings of different thickness. Of course, the utilization of the adjustment portion 44 can be combined with clamping the attachment portion 8 into the attachment portion 13 in an inclined manner.

A finishing profile 3 according, amongst others, the sixth aspect of this invention is represented in FIG. 7. From manufacturer's side, the finishing profile 3 is constructed such that the flange-shaped portion 7 comprises a nose portion 11 under only one edge, which nose portion is attached in one piece, however, separable, at the flange-shaped portion 7 of the finishing profile 3. In the represented embodiment, the nose portion 11 is connected to the flange-shaped portion 7 solely by a remaining weakened material portion 45, directly underneath a layer-shaped covering 46. The industrially manufactured construction is obtained by forming a recess 47 in an end profile 4, as the one shown in FIG. 1, said recess extending practically up to the layer-shaped covering 46.

FIG. 18 shows a finishing profile 3 for a floor covering 24 according, amongst others, the eighth aspect of this invention. Here, a finishing profile 3 is concerned that substantially consists of a body formed by several, in this case, three, mutually separable portions, whereby one of the separable portions is realized as a flange-shaped portion 7 extending to the left and right from an attachment portion 8 situated at the lower side thereof, and whereby the two other separable portions are realized as nose portions 11, which, in function of the intended application, may or may not be removed from the flange-shaped portion 7. One of the nose portions 11, namely the right one in FIG. 18, shows an obliquely sloping outer side or end wall 12, whereas the other nose portion 11, namely the left one in FIG. 18, shows an outer side or end wall 12, which is steeper than that of the first-mentioned nose portion 11 and, as shown, may be vertical.

Each nose portion 11 is situated next to an edge of the flange-shaped portion 7 and, in the represented form of embodiment, is resting directly against this flange-shaped portion 7 in that it is coming into contact therewith in vertical direction by means of stop surfaces 48, such that a good transfer of forces is guaranteed. Also, in the representation of FIG. 18, there is a contact in horizontal direction by means of stop portions 49, such that a good resistance against lateral forces is obtained. A similar resistance against lateral forces can be obtained by providing stop portions 49A and/or 49B on the holder 2. Such holder 2 is shown in FIG. 18 in dashed line.

A finishing profile 3 according to the eighth aspect, as the one shown in FIG. 18, can be manufactured by first separately producing the three parts coming into mutual contact, in this example, thus, the flange-shaped parts 7 and the two nose portions 11, either by extrusion of synthetic material, aluminum, wood, and so on, or by machining operations and the like in, for example, plywood, or another wood-based material, for example, MDF/HDF, and thereafter commonly encasing said contacting parts with a layer-shaped covering 46, which keeps them together. It is not excluded that, before realizing the encasing, first a treatment is performed that guarantees the precision of the assembled, not encased assembly, for example, by commonly cutting the outwardly directed sides of the assembled portions to size.

When the finishing profile 3 of the type of FIG. 18 is applied as a transition profile 6, the user must remove the nose portion 11 shown in the figure on the left hand side. If an application as an end profile 4 is required, the user must remove the nose portion 11 shown in the figure on the right hand side. An expansion profile 5 is obtained by removing both nose portions 11 and keeping only the flange-shaped portion 7.

FIG. 19 shows how a nose portion 11 can easily be removed by pivoting, amongst others, the respective nose portion 11. In this manner, the layer-shaped covering 46 will fold and a cutting line or fold will show, where the user can position his knife 50 in order to cut the layer-shaped covering 46. Tearing or breaking the layer-shaped covering 46 is also possible. When applying a layer-shaped covering 46 of a sufficiently brittle nature, for example, a suitable thermosetting laminate, the layer-shaped covering 46, when pivoting the nose portion 11 to be removed, will break by itself.

It is clear that a finishing profile 3, as represented in FIG. 18, may also be manufactured by means of extrusion, whereby this finishing profile 3 then comprises weakened parts where the separable-realized portions can be broken off, torn off or cut off. In this manner, a finishing profile 3 is obtained that fulfills the seventh aspect of the invention, which has been set forth in the introduction. Hereby, then a layer-shaped covering 46 may or may not be present at the visible side of this extruded finishing profile 3.

Said layer-shaped covering 46 may, for example, consist of a printed foil, for example, of the type usually applied as an encasing foil. Other coverings 46, however, are not excluded.

FIG. 20 represents an application of a variant of the finishing profile 3 of FIG. 18, whereby it is applied as a transition profile 6 and, consequently, the left nose portion is removed. The particularity of this variant consists in that the finishing profile 3 has locking means or parts 51, which prevent that a nose portion 11, when manipulating the finishing profile 3 before and during the installation thereof, in an undesired manner moves out of the position in which it rests against the flange-shaped portion 7. This undesired movement of the nose portion 11 does not promote an easy installation. Moreover, this movement may lead to an undesired breaking off or tearing of the layer-shaped covering 46 or an undesired appearance of a folding line therein. It is clear that the application of such locking means or portions 51 is also beneficial when encasing the body of the finishing profile 3 in case it is composed of several portions. In fact, such layer-shaped covering 46 may generate residual tension forces after being applied, which forces may rotate the nose portion out of its desired position. In the example of FIG. 20, this rotational movement is prevented by the applied locking means.

FIG. 21 shows a further variant of a finishing profile 3 according to the eighth aspect, whereby at least one nose portion 11, and in this case both nose portions 11, are made separable by attaching the actual nose portion 52 each time by a removable, and whether or not re-usable, adhesive and/or glue connection, formed by adhesive 53, at the layer-shaped covering 46. The advantage of this variant is that, after removal of the respective actual nose portion 52, always a nicely finished edge can be realized by folding, and preferably also fixing, as indicated by arrow 54, the then remaining respective protruding portion of the layer-shaped covering 46 underneath the flange-shaped portion 7 of the finishing profile 3. Possibly, to this aim the layer-shaped covering 46 must be shortened by cutting away a part thereof. The quality of this cut, however, is not critical, in consideration of the fact that said cut, when the layer-shaped covering 46 is folded under the flange-shaped portion 7, will not be visible when utilizing the finishing profile 3. Moreover, the possibility of removing the nose portion 11 according to the method shown in FIG. 19, still remains applicable.

It is clear that the locking means 51 in FIG. 21 are optional. Also, instead of such locking means 51, use can be made of a, whether or not re-usable, adhesive and/or glue connection between the lower side of the flange-shaped portion 7 and the upper side of the respective nose portion 52.

According to a variant, which hereafter is described with reference to FIG. 21, the finishing profile 3 is delivered as a set of components consisting of, on the one hand, a flange-shaped portion 7, whereby the layer-shaped covering 46, at least at one edge of the flange-shaped portion 7, partially extends beyond the body of the finishing profile 3, whereas the respective portions of the layer-shaped covering 46 are provided with an adhesive 53 and preferably with a removable protective layer applied on top of the adhesive, and, on the other hand, one or more nose portions 11 without layer-shaped covering 46, which then, by means of the aforementioned adhesive, can be fixed against the lower side of the protruding layer-shaped covering 46. Within the scope of the invention, it is possible that the adhesive is also or solely provided on the nose portions 11, more particularly in fact the nose portions 52. Preferably, the aforementioned components, namely the flange-shaped portion 7 with its layer-shaped covering 46 and one or more portions 52, will be packaged together. If the user wants to provide the finishing profile 3 with a nose portion 11, he will provide the respective actual nose portion 52 under the respective edge of the flange-shaped portion 7, remove said protective layer from the respective protruding part of the layer-shaped covering 46 and finally interconnect the layer-shaped covering and the actual nose-portion 52 by providing for that this layer-shaped covering and the respective actual nose portion 52 will be adhered to each other by means of the adhesive 53. Summarized, this means that one or more of the actual nose portions 52 represented in FIG. 21 are delivered separately and are provided by the user, as indicated by arrows 55, against the lower side of the protruding parts of the layer-shaped covering 46. In this case, too, a protruding part of the layer-shaped covering 46, which is not connected to a nose portion 52, can be folded towards the inside and be glued against the lower side of the flange-shaped portion 7, for example, as indicated by arrow 54.

In order to facilitate the possible shortening of the folded-down portion of the layer-shaped covering 46, auxiliary means may be provided at the lower side of the flange-shaped portion 7, such as, for example, a recess 56, above which first the layer-shaped covering 46 is provided and into which the tip of a knife easily can be put in order to obtain, already cutting, guided by this recess 56, a high-quality cut. In FIG. 21, the represented locking means 51 additionally may fulfill the function of said recess 56.

Possibly, the protruding portions, provided with adhesive 53, of the layer-shaped covering may protrude that far that they can be folded down; up to under the nose portions 11.

FIG. 22 shows a variant of the embodiment of FIG. 21, whereby the locking means 51 are realized in another manner, namely, as a snap connection, which provides for that a support is offered laterally in both directions and therefore shifting forces in the layer-shaped covering at the height of the transition between the flange-shaped portion 7 and the nose portion 11 are avoided.

FIG. 23 relates to a set of components for forming a finishing profile 3 for a floor covering 24 according to the ninth aspect of this invention. The set consists of at least two, in this case three, components, whereby the first component is a flange-shaped portion 7 with an attachment portion 8 situated at the lower side, whereas the second and the third component consist of a nose portion 11 that can cooperate with the lower side of the flange-shaped portion 7, in such a manner that, by whether or not applying one of the two nose portions 11, three usage possibilities are created, namely, the use as an expansion, transition, or end profile. Between the nose portions 11 and the flange-shaped portion 7, attachment means 55 are provided, more particularly adhesive portions 57 obtained by an adhesive that has been provided on such nose portion 11 by manufacturer's side. In order to facilitate the attachment of the nose portions 11 by means of the adhesive portions 57, abutment surfaces 48 and/or abutment portions 49 can be provided on the flange-shaped portion 7. These abutment surfaces 48 and/or abutment portions 49 are represented in dashed line in FIG. 23. A packaging unit for such set of components preferably contains at least one flange-shaped portion 7 and at least one nose portion 11. Even more preferably, the packaging unit contains at least one flange-shaped portion 7 and two different nose portions 11. In FIG. 23, the adhesive that is provided on the nose portions 11 is covered by a protective layer 58. It is noted that such adhesive portion mostly is not thick, such that providing a recess 59 for applying said adhesive therein, as represented in the figure, mostly is redundant.

According to the tenth aspect of the invention, which is not represented in the figures, it is possible that the adhesive portions 57 are not provided on the nose portions 11 from manufacturer's side, but are packaged together with such nose portion 11. Preferably, the enclosed adhesive portion 57 then will consist of a double-sided self-adhesive strip that can be provided by the user between the flange-shaped portion 7 and the respective nose portion 11.

FIG. 24 shows the application of a variant of the type of finishing profile 3 of FIG. 18. The nose portion 11 is connected to the flange-shaped portion 7 solely by means of a layer-shaped covering 46. According to a particular characteristic, also a mechanical locking 51 between the nose portion 11 and the holder 2 is present, which, in the example, is realized as a snap connection.

FIGS. 25 and 26 show another variant of a finishing profile 3 of the type of FIG. 18, whereby, in this case, the stop portion 49 is designed such that a possible rotational movement 60 of the nose portions 11 around the distal extremity 61 of the flange-shaped portion 7 is prevented, counteracted or limited. Such rotational movement 60 may, for example, occur under the influence of residual tension forces in the layer-shaped covering 46, as discussed above in respect to FIG. 20. In the examples represented here, the stop portion 49 is carried out vertically and is situated at least partially above the horizontal plane H1 defined by said distal extremity 61 of the flange-shaped portion 7. In this represented configuration, the nose portion 11 shall be prevented from performing said rotational movement 60, as the stop portion 49, at least for the portion situated above the horizontal plane H, blocks the rotational movement 60.

It is clear that such rotational movement 60 can be prevented by any form of suitable blocking portions or stop portions. Possibly, these portions may be designed such that they indeed offer a blocking against forces exerted by the layer-shaped covering 46, however, allow that the respective nose portions 11, by means of a larger force, can be turned away from their blocked positions.

The blocking portions do not necessarily have to consist of a stop-forming mechanical part. For example, they may also consist of a releasable adhesive connection or any other releasable connection, which is provided, for example, between the upper side of the respective nose portion 11 and the lower side of the respective flange portion 7.

It is clear that the use of such nose portions 11 and blocking portions is possible at one edge as well as at both edges of a finishing profile 3.

FIG. 27 shows a variant, whereby the stop portions 49 are inclined.

It is noted that said blocking does not have to be absolute and, therefore, a small freedom of movement is not excluded. This is illustrated in the nose portion 11, represented on the left hand side in FIG. 27, which can perform a small free rotational movement 60. However, the respective stop portion 49 limits this rotational movement to the position of the nose portion 11 represented in dashed line 62.

In the examples of FIGS. 25, 26 and 27, at the height of the transition between two portions, for example, at the height of the transition of the nose portion 11 and the flange-shaped portion 7, directly below the layer-shaped covering 46, a space 63 is provided, which, for example, may be formed by the recess 59. By providing a space 63, which extends towards the outside up to the layer-shaped covering 46, it is obtained that the risk of lines or edges showing in the layer-shaped covering 46 at the height of the respective transition is minimized. The transition between the nose portion 11 and the flange-shaped portion 7 now will have to be finished less accurately in order to achieve a satisfying result. This means that in an easy manner, a result is achieved whereby the decorative side or the exterior side 12 of the nose portion 11 connects in a fluent manner to the decorative side of the flange-shaped portion 7. Also, the space 63 represented in FIGS. 25, 26 and 27 allows a knife or the like to be moved smoothly through this space 63.

In FIG. 28, another application of a finishing set 1 according to the present invention is represented, whereby the finishing profile 3 serves as a skirting board. Hereby, the holder is attached to the wall 23. In the variant of FIG. 29, the holder comprises a positioning portion that can form a stop with the subfloor 26, such that the attachment portion 13 of the holder and the skirting board or finishing profile 3 attached thereupon automatically are positioned at the right distance above the subfloor 26.

FIGS. 30 to 32 show more variants and applications of a finishing profile 3, which, amongst others, shows the characteristics of the eighth aspect of the present invention. The particularity of these variants is that the flange-shaped portion 7 in its turn is composed of several flange portions 64. In the case of the represented examples, the flange-shaped portion 7 consists of two identical or almost identical flange portions 64. FIG. 31 shows that such flange portion 64 on its own can be applied as an end profile 4.

A configuration, as shown in FIGS. 30 and 32, with two different nose portions 11 and two flange portions 64, leads to a large number of usage possibilities, which are combined in one composed product. So, for example, by means of the configuration represented in FIG. 32, which also comprises two different flange portions 64 that can each be applied separately, five different finishing modes can be performed in a floor covering 24, which modes are summarized below:

- by using the flange portion 64, represented at the left hand side in FIG. 32, a relatively wide end finishing can be obtained, of the type as shown in FIG. 31;
- by using the flange portion 64, represented at the right hand side in FIG. 32, a more narrow end finishing of the same type is obtained;
- by removing only the nose portion 11 represented at the left hand side in the figure, a relatively brisk transition can be obtained, in view of the fact that the remaining nose portion 11 has a relatively steep outer side 12;
- by removing only the nose portion 11 represented at the right hand side in the figure, the user can obtain a less brisk transition than in the case mentioned above, in view of the fact that the remaining nose portion 11 has a globally less steep outer side 12 than the nose portion 11 represented at the right hand side in the figure;
- by removing both nose portions 11, the user obtains an expansion profile 5 with which an expansion joint in a floor covering can be finished.

It is clear that implementing the flange portion 7 in at least two flange portions 64, as described above, is also advantageous with finishing profiles that do not show the characteristics of the eighth aspect.

FIG. 33 shows an example of a knife 65 with which, as represented in FIG. 34, a nose portion 11 can be removed. In the represented example, the knife 65, by which in this case the entire tool is meant, comprises a hook-shaped cutting edge 66 and a holder 67, such as an eye 68, by means of which the user can handle the knife 65. The shape of the knife is such that the risk of the user injuring himself is minimal. Preferably, the knife 65 is designed as a disposable knife that can be packaged together with the finishing profile 3. The specific shape of the knife 65 represented in FIG. 33, in particular the hook-shaped cutting edge 66, allows that the user easily can insert the knife 65, by means of its tip 69, for example, into the distal extremity 70 of the finishing profile 3 via the recess 59 or the space 63, whereas the eye 68 remains available at the exterior of the finishing profile 3 in order to draw the knife 65 forward in the longitudinal direction of the finishing profile 3. This recess 59 or space 63 then serves as a guide for the knife 65. The recess 59 or space 63 can also be intended solely as a guide for the knife 65.

Of course, also other than hook-shaped cutting edges 66 can be applied for the knife 65, and also the eye 68 may be replaced by any other holder 67 with which the user can handle the knife 65. In a particular form of embodiment, the knife 65 is realized as represented in the FIGS. 35 and 36. Hereby, the holder 67 consists of a particularly shaped block comprising, for example, recesses 71 which can receive the fingers or fingertips of the user. The cutting edge 66 is situated at a blade present at the lower side 72 of the holder 67.

As represented in FIG. 37, the lower side 72, due to its specific shape, forms a guide surface with which the knife 65 can slide over the finishing profile 3, for example, over the layer-shaped covering 46 of the flange-shaped portion 7. In this manner, the knife 65 automatically is positioned at the right location, in this case, with its tip 69 in the space 63 or recess 59, such that, when advancing the knife 65, the layer-shaped covering is cut by means of the hook-shaped cutting edge 66, as represented in the view of FIG. 38.

It is clear that such knife 65 with a profiled guide surface adapted to the shape of a finishing profile can be realized in other forms, too.

It is noted that, in the represented example of FIG. 35, the holder 67 is provided with a mark 73 indicating the direction into which the knife 65 has to be moved.

FIG. 39 represents a set of components for forming a finishing profile 3 showing, amongst others, the characteristics of the eleventh aspect of the present invention. To this aim, the set, in this case, consists of two components 74 and 75, amongst which a first component 74 comprising a flange-shaped portion 7 with an attachment portion 8 situated at the lower side, and a second component 75 that can cooperate with the first component 74 in at least two usage positions. In this example, said component 75 is composed of two mutually separable nose portions 11, respectively with decorative sides 76 and 77, which are intended to form a vertical and an inclined outer side 12 and which, in this case, are formed by a layer-shaped covering 46. It is clear that in use, both nose portions 11 are detached from each other and then the desired nose portion 11 is mounted under the first component 74. It is clear that then, depending on which nose portion 11 is applied, the decorative side 76 or 77 comes into a position whereby it adjoins to the decorative side of the flange-shaped portion 7. In the example of FIG. 39, the decorative side 76 is situated in such a position.

In FIG. 39, the separable nose portions 11 are realized in one piece and are connected to each other by a weak material portion 78, where they can be separated from each other. Instead of such material portion 78, also other connection means might be applied.

FIG. 40 represents a particularly preferred form of embodiment of the eleventh aspect of the present invention, whereby the second component 75 as a whole can be used for forming a finishing profile 3, whereby, at choice, the first side 76 or the second side 77 is brought into a position whereby its decorative side adjoins to the decorative side of the flange-shaped portion 7. In the example, this second portion 75 is realized as a nose portion 11 extending downward at one edge of the flange-shaped portion 7. Hereby, the side 76 is brought into a position in which it adjoins the decorative side of the flange-shaped portion 7, such that the assembly of the first component 74, namely the flange-shaped portion 7, and second component 75, namely the nose portion 11, forms a transition profile. By the dashed line 79, a position is given in which the decorative side of the side 76 adjoins the decorative side of the flange-shaped portion 7, such that the assembly of the two components 74 and 75 forms an end profile 4. In the represented example, the attachment among the components 74 and 75 takes place by means of an adhesive connection, however, according to variants, also other connection means may be applied.

FIGS. 41 and 42 represent two variants of the eleventh aspect of the invention, whereby FIG. 41 possesses one component 75, whereas FIG. 42 comprises two components 75. The decorative sides 76 and 77 respectively are located at one and the same visible side of the respective component 75. The two possible usage positions of such components 75 are represented in the FIGS. 41 and 42. In FIG. 41, an end profile 4 is formed by having the side 77 with its decorative side adjoin to the decorative side of the flange-shaped portion 7. Hereby, the second side 76 forms the steep outer side 12 of the end profile 4. In FIG. 42, on the contrary, an expansion profile 5 is formed by having the side 76 adjoin with its decorative side to the decorative side of the flange-shaped portion 7.

In general, the connection means between the components 75 and 76 may be of any form. Apart from the adhesive connection, an example of which is given in FIG. 40, use may also be made of portions fitting into each other, such as a tongue and groove, as illustrated, amongst others, in FIGS. 39 and 41, whereby these portions, whether or not in a clamping manner, fit into each other or are made as a snap coupling. Also, separate inserts 80 may be applied as connection means, which is represented in FIG. 42.

It is clear that the invention also relates to a nose portion 11 itself, which is formed such that it can be applied in two or more usage positions.

Referring to FIG. 39, it is further noted that the represented specific composition of the first component 74 and the second component 75 has advantages in respect to the packaging of this set of components and the production thereof.

In respect to the packaging, it is quite evident from FIG. 39 that both components 74 and 75 can be provided against each other in a very compact manner, such that the packaging, too, will be compact. In order to enable such compact packaging, the second component 75 is provided with a recess 81 that can receive the attachment portion 8 of the first component 74. This recess 81, which receives the attachment portion 8, contributes to a package that may be realized more simple than, for example, the packaging of the same loose components. Other measures that help with packaging are, on the one hand, the presence of only two components 74 and 75, which, however, as in the example, can be removable, and, on the other hand, the engagement of applied connection means or parts 82 between both components 74 and 75.

In respect to the production of both components 74 and 75, and more particularly to the encasing thereof with the layer-shaped covering 46, it is possible to choose a method whereby the circumference of a semi-finished product comprising both components 74 and 75, such as the one represented by dashed line 83, is encased, preferably with an uninterrupted layer-shaped covering 46. Hereby, in the represented example, the second component 75, on one side 84, is not yet provided with a profile, however, realized almost flat at this side 84, with the exception of possible rounded portions at the corners of this side 83. Thus, said semi-finished product in dashed line 83 shows a contour that is easy to encase. The excessive material 85 at the side 84 of the second component 75 is removed after encasing in order to obtain the desired profiling. In case the layer-shaped covering 46 on the aforementioned contour will be interrupted during encasing, it is preferred to provide this interruption on the side 84, from which the excessive material 85 will be removed.

FIG. 43 represents a particular form of embodiment, whereby the nose portions 11 are coupled to the holder 2 by means of coupling parts 86, whereby these coupling parts 86 preferably effect at least a locking in lateral direction. In the represented example, these coupling parts 86 consist of projections 87 at the holder 2, which engage in recesses 88 in the nose portions 11; however, it is clear that according to variants, also other coupling parts 86 may be provided.

The portions 89-90 that carry the coupling parts 86, and more particularly the projections 87, preferably are realized removable, more particularly to be broken off, in respect to the remaining portion 19, to which end, as represented, break-off lines 18 may be provided in the holder 2.

The coupling parts 86 between the holder 2 and the nose portions 11 may be applied for various reasons, however, practically they first of all aim at having the nose portions 11 fixedly positioned below the flange-shaped portion 7. Hereby, the nose-shaped portions 11 and the flange-shaped portion 7 either may be provided with separate layer-shaped coverings 46, or be provided with a continuous layer-shaped covering extending continuously from on top of the flange-shaped portion 7 up to on top of at least one nose portion 11, as described in the eighth aspect of the invention. When applying the eighth aspect of the invention, the coupling parts 86 provide for that the composing parts automatically are mutually positioned before the layer-shaped covering 46 is applied. Moreover, these coupling parts 86 prevent that the nose portions 11, after the application of the layer-shaped covering 46, turn outward due to the influence of internal tensions.

As represented at the right-hand side of FIG. 43, the covering 46 possibly may be applied partially over the holder 2.

It is clear that all that is described above in respect to FIG. 43, is also possible in embodiments having only one removable or combinable nose portion 11.

According to a particular variant, one or more of the nose portions 11 will be made in one piece with the holder 2, for example, by means of extrusion. Such integrally made nose portion 11 then may be provided, in its turn, with a layer-shaped covering 46, whether or not implemented continuously with a layer-shaped covering 46 on the flange-shaped portion 7.

FIG. 44 shows another particular form of embodiment of said eighth aspect, whereby the nose portions 11 and the flange-shaped portion 7 and attachment portion 8 are made in one piece, however, these nose portions 11 are connected to the flange-shaped portion 7 and/or the attachment portion 8 by means of weakened portions 91-92, where the nose portions 11 can be separated, for example, cut off or broken off. Hereby, the portions 91-92 are situated on proximal locations, which are obtained in that notches 93-94 are formed in the whole, in such a manner that the nose portions 11, during the application of the integral layer-shaped covering 46, can be pressed with their edges 95-96 up to against the flange-shaped portion 7. After the covering 46 has been applied, the nose portions 11 then remain in the position as indicated in dashed line 97-98.

It is noted that, as represented in FIGS. 41 and 42, a removable nose portion 11 does not necessarily have to be limited to a portion situated exclusively underneath the flange-shaped portion 7, but that such removable nose portion 11 may also be situated laterally in respect to the flange-shaped portion 7 and thus forms a kind of prolongation thereof. FIG. 45 shows another example thereof, which also forms a deviating variant of said sixth aspect and in which moreover also the eighth aspect is applied. More particularly, in this form of embodiment, the nose portion 11 represented on the left hand side in this figure is situated substantially sideways from the flange-shaped portion 7 and is realized, so to speak, as a prolongation of the flange-shaped portion 7. The nose portion is realized in one piece, however, separable, with the remaining portion of the finishing profile 3. In the represented example, the separability is obtained in that the nose portion 11 is connected to the flange-shaped portion 7 solely by means of the layer-shaped covering 46 and a remaining material portion 45. This embodiment can be obtained in a simple manner by forming a recess 47 at the underside of the finishing profile 3 almost up to the layer-shaped covering 46, or by providing any other kind of weakened material portions. It is clear that any other connection between the nose portion 11 and the flange-shaped portion is possible, such as a connection solely by means of the layer-shaped covering 46, or a connection by means of separate inserts.

Whereas the finishing profile 3 in FIG. 45 is applied as an end profile 4, it may, as represented in FIG. 46, also be used as a skirting board, by removing the nose portion 11 represented at the left in FIG. 45. By removing the nose portion 11, the obtained skirting board in this case perpendicularly adjoins the floor covering 24.

The possibility of realizing an end profile 4 as well as a skirting board by means of only one finishing profile 3, is of particular importance, as, when finishing a floor covering 24 against a wall 23, usually at least one of the two, either an end profile 4, or a skirting board, are applied. Thus, starting from one and the same finishing profile 3, the user himself may choose whether he applies it as an end profile 4 or as a skirting board.

It is clear that the FIGS. 28, 29 and 45-46 form examples of the thirteenth aspect of the invention, mentioned in the introduction.

FIG. 47 represents a variant of the knife 65 of FIG. 35. Hereby, the shape of the holder 67 is adapted such that the knife 65 or the holder 67 as such has at least one additional function that is useful in the installation and finishing of a floor covering 24.

In the represented example, the holder 67 of the knife 65 comprises a projection 99 on at least one upper edge. Such design allows to use the knife 65 or the holder 67, as represented in FIGS. 48 and 49, also can be used as a tapping block when installing a floor covering 24. This relates in particular to a floor covering 24 of the type that is placed in a glueless manner, by assembling this floor covering 24 by means of floor panels 100 comprising coupling means or coupling parts 101 on at least two of their edges. These coupling means or parts 101 allow to connect them with an adjacent floor panel 100. Such floor panels 100 are known, for example, from document WO 97/48734. The coupling parts 101 of the type of floor panel 100 shown in FIG. 49 allow that two of such floor panels 100 can be coupled, amongst others, by means of a substantially horizontal shifting movement S. This horizontal shifting movement S can be applied to the floor panel 100 by means of a stroke of a hammer 102 against the tapping block or holder 67. Hereby, preferably only the projection 99 of the holder 67 touches the floor panel 100. Preferably, the contact between the holder 67 and the floor panel 100 occurs at the upper side edge of the floor panel 100, such that the coupling means or parts 101 in the proximity of this holder 67 are not damaged.

Independently from the actual shape of the knife 65 or the holder 67, allocating several functions to one accessory, such as to the knife 65 or to a tapping block, as such is particularly important, as this limits the number of accessories that are required for installing or finishing a floor covering. In the case of an accessory that can be used as not only as a knife 65, but as a tapping block as well, it is clear that the design of the holder 67 can vary according to the design of the coupling means or parts 101. Preferably, the design is such that the tapping block or holder 67 touches the floor panel 100 solely in zones where the risk of damaging the floor panel 100 and its coupling means or coupling parts is minimal.

According to another form of embodiment, also a piece of abrasive paper or other abrasive part can be integrated into the holder 67. This abrasive paper as such can be used for various purposes, however, in particular may be used for polishing, after the removal of a nose portion 11 of the finishing profile 3, the flange-shaped portion 7 of the finishing profile 3 at the height of the edge where said removed nose portion 11 has been cut off.

Such abrasive part can be integrated into the holder 67 at different places. So, for example, this may be at a place, such, that the holder 67, in a certain position, may be used as a knife, whereas, in another position, it may be used as a grinding block. Preferably, however, this abrasive part will be integrated such that it can be commonly applied with the knife, in other words, such that, directly upon cutting, also a grinding is obtained. This is possible, for example, either by providing the abrasive part directly following the blade of the knife, or by integrating an abrasive part into the blade, for example, by providing the blade with an abrasive coating behind the cutting edge, or by realizing it as a file.

Also, it is not excluded not to integrate the abrasive part into the knife 65, but to offer it as a separate element, for example, in the form of a grinding block, along with the finishing profile.

FIG. 50 represents another variant of the embodiment of FIG. 25. Herein, both nose portions 11 are locked in both lateral directions by means of the stop portions 49 and 49C.

As indicated by portion 103 in FIG. 50, the nose portions 11 first may be manufactured as a unitary whole, in order to be subsequently provided, together with the flange-shaped portion, with the layer shaped covering 46, for example, by encasing, after which the portion 103 is removed, for example, milled away. The portion 103 keeps the whole together in a stable manner during the provision of the layer-shaped covering 46. Also, the outer surface against which the covering 46 must be provided, can be formed in the mounted condition, prior to removing the portion 103, with as an advantage that the exterior contours of the flange-shaped portion 7 and of the nose portions 11 perfectly adjoin each other and that, after applying the layer-shaped covering 46, no visible transition will be present any more.

It is clear that, with embodiments that are realized according to the eighth aspect of the invention, such as the embodiment of FIG. 50, this aspect will be particularly beneficial when the layer-shaped covering 46 consists of a proper material layer, for example, formed of an encasing material which, as such, can resist a certain tension force and therefore does not solely exist of a print or the like, although this latter, in certain applications, is not excluded. In the case of a foil or thermosetting laminate, the covering 46 preferably has a thickness of 0.1 to 0.5 millimeters.

According to the fifteenth aspect of the invention, the finishing profile 3, or a portion 7-11 for forming such finishing profile 3, is provided at its decorative side with a pattern that is at least partially and preferably entirely formed of a hardening substance, which is provided on the finishing profile or the portion thereof and has hardened thereupon. In the first place, this means that the finishing profile 3, or one or more portions 7-11 thereof, are provided with a printed thereupon or printed pattern, whereby the hardening substance, thus, is an ink or other hardening, or, in other words, drying substance, and whereby this pattern thus is formed on the already formed surface of the profile, and thus not beforehand on a foil or the like, which then is provided on the finishing profile. The pattern may be of any nature. In a large number of applications, however, this will be a wood pattern. Other depositing techniques than by means of a printer are not excluded.

FIGS. 51 to 55 schematically represent a number of possibilities in accordance with the fifteenth aspect.

Figure 51:
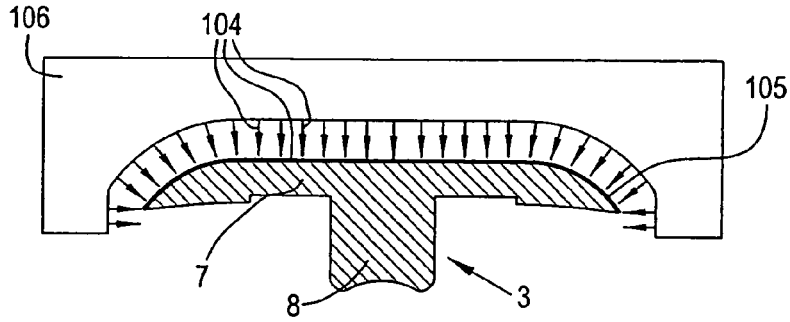

In FIG. 51, a pattern 105, by means of a hardening substance 104, such as ink, is directly provided on the basic material of a finishing profile 3 or a portion thereof, in this case, the flange-shaped portion 7 thereof, such that, after the hardening or, in other words, drying of the substance 104 a printed surface is retained. As schematically represented in FIG. 51, this is preferably performed by means of a printing unit 106, for example, an ink-jet printer, which applies the pattern in the form of a print.

According to a variant, a primer or other layer will be provided on the finishing profile 3, or on said portion, underneath said pattern 105.

Figure 52:
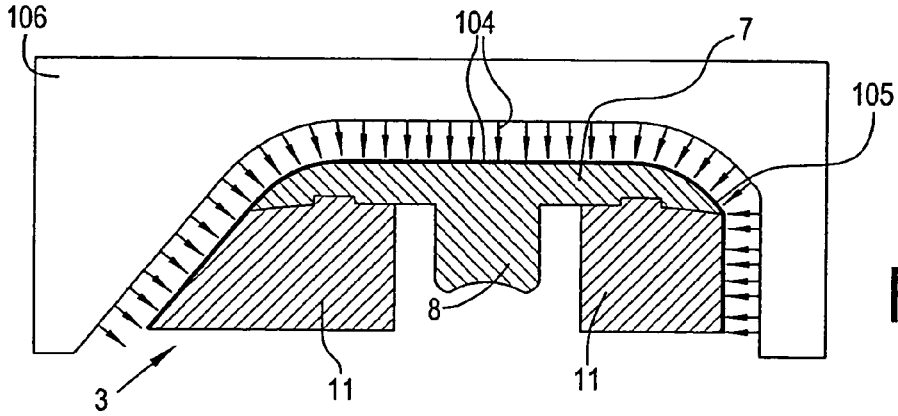

FIG. 52 represents how the print is provided on a finishing profile 3 consisting of several portions 7-11, said profile having already been assembled. Hereby, a print is obtained which merges from one portion into the other in a continuous manner.

Figure 53:
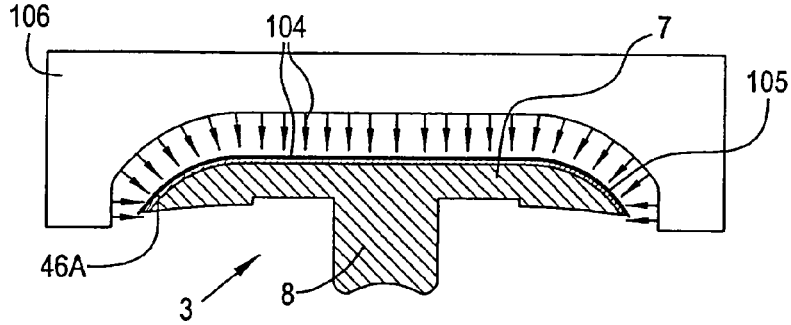
Figure 54:
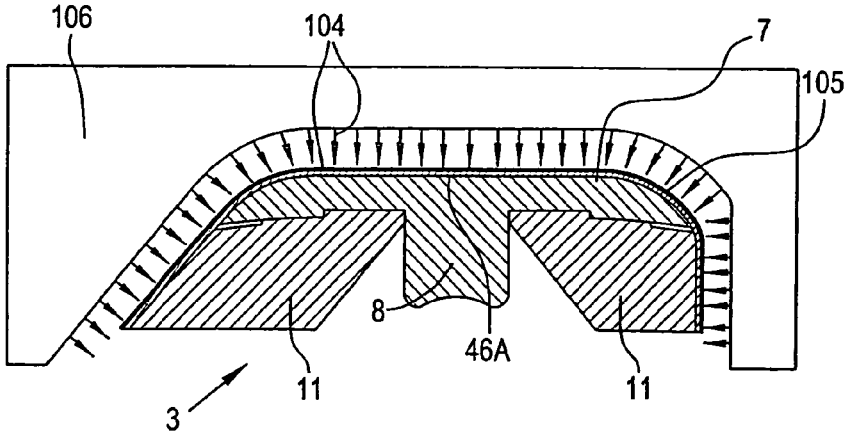

FIG. 53 represents a variant in which the printed pattern 105 is provided, more particularly printed, on an encasing layer 46A, which is already present at the finishing profile 3 or at said portion 7. Of course, other layers, too, may be provided. FIG. 54 represents a variant in which the layer-shaped covering 46A made of encasing material keeps the different portions 7 and 11 together.

At the decorative side, a wear-resistant substance may be provided, for example, by covering the pattern with a transparent lacquer or varnish, in which corundum particles are incorporated. Also, embossments may be formed in the surface, which form a surface structure, for example, for imitating wood pores.

The fifteenth aspect may be applied to finishing profiles 3 and/or portions 7-11 of any basic material, thus, to wood-based products, such as MDF/HDF and plywood, as well as to metal and synthetic material.

The invention also relates to a method for manufacturing a finishing profile or a portion of a finishing profile according to the fifteenth aspect. This method consists in that the finishing profile 3 or one or more portions thereof, either in completely finished form, or as a semi-finished product, are displaced relatively along a unit that provides a hardening substance in the form of a pattern on the finishing profile and/or said portion, more particularly a printing unit, preferably an inkjet printer, after which the substance is left to harden.

FIGS. 51 to 54 respectively show an embodiment in which the respective workpiece, thus, the finishing profile 3, or a portion thereof, is displaced relatively along said unit 106 by displacing this workpiece and the unit 106 in mutual respect in the longitudinal direction of the workpiece. Thereby is meant, for example, that the unit 106 consists of a printer, which locally is active on a line and that the respective workpiece is moved in longitudinal direction therealong. Of course, also the unit 106 may be displaceable over the workpiece.

As represented in the schematic representations of FIGS. 51 to 54, the unit 106, in respect to its shape, may be adapted to the workpiece to be treated, for example, by realizing this unit as a printing head following the shape of the surface to be printed.

Figure 55:
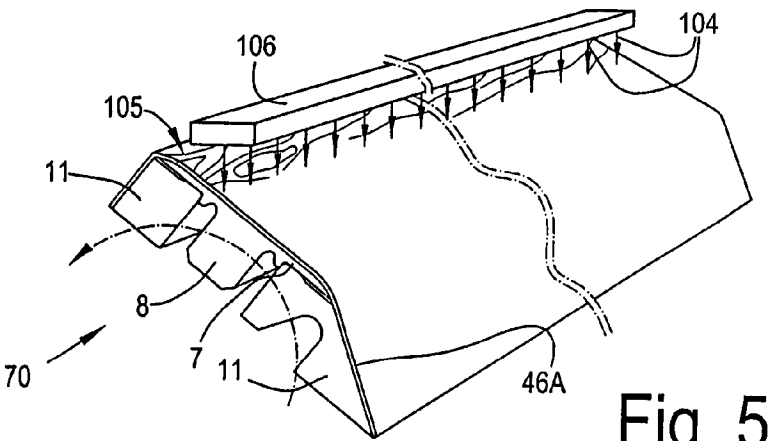

FIG. 55 represents an embodiment in which the respective workpiece, thus, the finishing profile 3, or a portion thereof, is displaced relatively along said unit 106 by displacing this workpiece and the unit 106 in mutual respect in the transverse direction of the workpiece. In this case, the unit 106 then may consist, for example, of a simple straight printer head, which does not have to be adapted to the shape of the workpiece.

The aforementioned sixteenth aspect relates to the manufacture of a skirting board. As explained in the introduction, a method is concerned which is analogous to the method described heretofore, however, applied to a skirting board rather than a finishing profile. Thus, the characteristics described by means of the fifteenth aspect can be applied in an analogous manner when manufacturing such skirting boards.

FIGS. 56 to 62 represent finishing profiles, which are realized, amongst others, according to the seventeenth aspect of the invention. As represented, hereby then a finishing profile for a floor covering is concerned, comprising a body formed of at least two portions, whereby these portions, in function of the intended application, can be separated from each other or brought together, and whereby the first of said portions shows a flange-shaped portion 7 and the second of said portions is a nose portion 11 that is or can be provided underneath the flange-shaped portion 7, with the decorative side of the nose portion adjoining to a downward-directed portion of the decorative side of the flange-shaped portion, with as a characteristic that said first and second portions are formed of separate basic bodies 107-108; that the basic bodies 107-108 themselves are free of mechanical connection parts fitting into each other, which are formed of the material of the basic bodies themselves; and that said basic bodies 107-108 are coupled to each other or can be coupled to each other by means of at least one separate connection 109.

Figure 57:
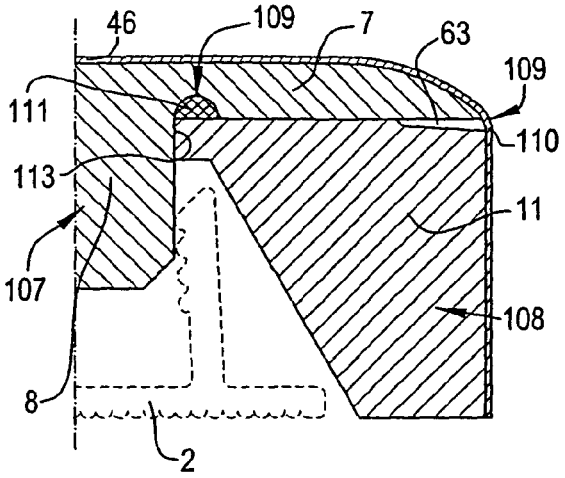

As can be seen in the represented examples, such separate connection can be of different kind and may one basic body 108 also be connected to the other basic body 107 by means of several separate connections. In each of the represented forms of embodiment of FIGS. 56 to 62, for example, each time use is made of a separate connection 109 in the form of a connection 110, formed by a layer-shaped covering 46 extending over the two basic bodies, or at least over the transition in between them. In the forms of embodiment of FIGS. 56 to 58, moreover also a separate connection 109 is applied in the form of an adhesive connection formed by glue, more particularly a strip of glue. To this end hot melt glue can be used. In the forms of embodiment of FIGS. 59 and 60 also a separate connection 109 is applied in the form of an adhesive tape connection 112. In the case of FIG. 57, this is double-sided adhesive tape.

Figure 61:
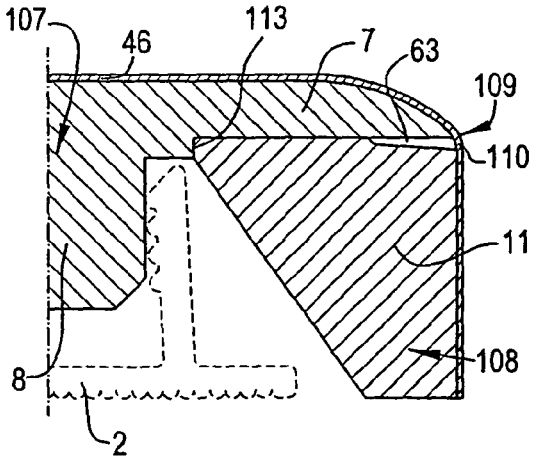
Figure 62:
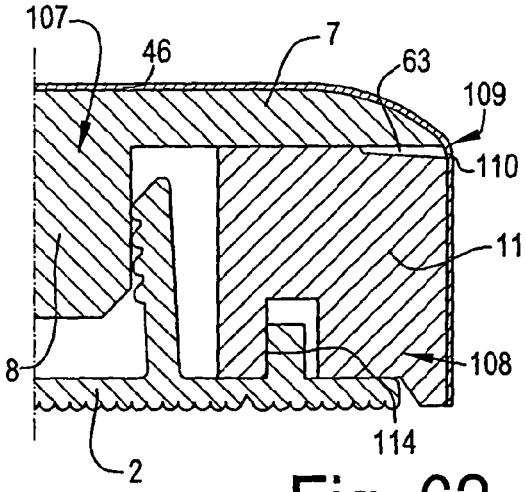

In the forms of embodiment of FIGS. 61 and 62, the separate connection 109 consists exclusively of the connection 110.

As can be seen in FIGS. 56, 57, 58, 60 and 61, the whole possibly may be designed such that the nose portion 11 laterally may cooperate with an abutment surface 113.

It is clear that the forms of embodiment of FIGS. 56 to 62, amongst others, also apply the eighth aspect of the invention. After cutting the covering 46 at the height of the connection 110, the respective nose portion 11 can be removed. In the embodiments of FIGS. 56 to 60, thereby also the adhesive connection 111-112 must be broken, for example, simply by pulling the respective nose portion 11 off.

In FIGS. 56 to 60, the connections 111-112 at least provide for that the respective nose portions will not turn outward on their own. According to FIG. 62, the nose portion 11 is prevented from turning outward by means of a stop 114 cooperating with a portion of the holder 2.

It is clear that the seventeenth aspect of the invention is not limited to the represented forms of embodiment. So, for example, the separate connection may also consist exclusively of an adhesive connection, whereas then no connection 110 by means of the layer-shaped covering will be present.

It is noted that in the embodiments according to the seventeenth aspect, the lower side of the flange-shaped portion and the upper side of the respective nose portion preferably adjoin each other with flat contact surfaces, whereby these are situated horizontal or substantially horizontal.

Figure 58:
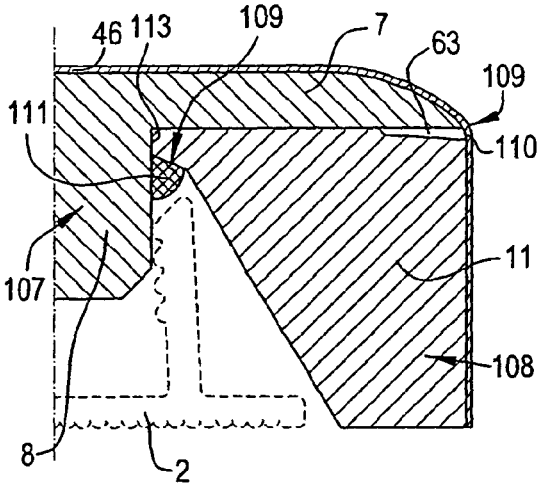
Figure 59:
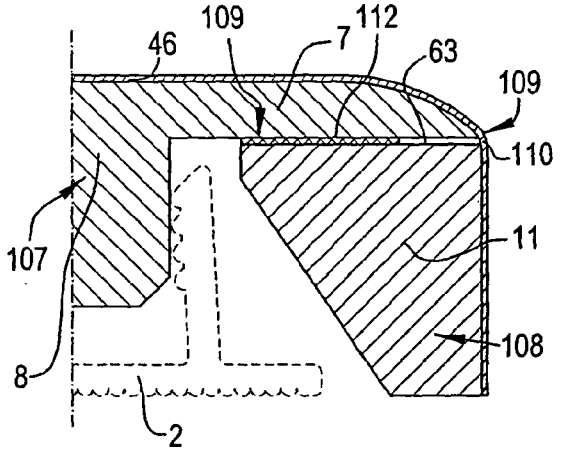
Figure 60:
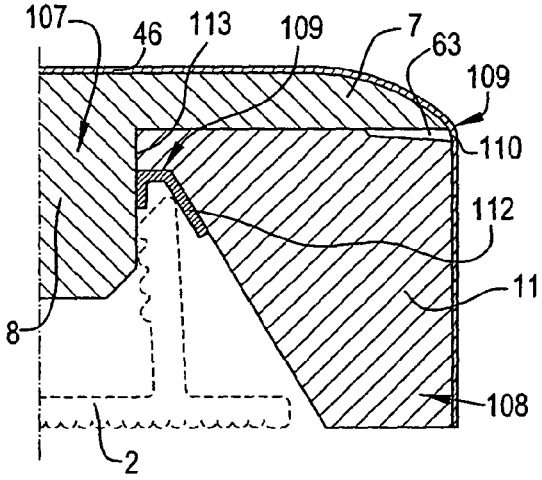

The fact that between a nose portion 11 and the side wall of an attachment portion 8, an adhesive connection is present, for example, such as depicted in FIGS. 58 and 60, as such forms an eighteenth independent aspect. An advantage thereof is that it can be provided without exerting an influence on the vertical cooperation between the respective nose portion 11 and the respective flange-shaped portion 7.

It is clear that all above-described connection techniques between a flange-shaped portion and a nose portion 11 can be applied at finishing profiles with one as well as with two nose portions, whereby in the latter case, such connection can be employed at one or both nose portions. When, in the latter case, such connection is applied at only one nose portion, the other nose portion may be realized in one piece with the flange-shaped portion 7.

Also, for two nose portions 11 of one and the same finishing profile, different kinds of connections can be provided with the flange-shaped portion 7. Thus, all combinations of different connections, selected from the above-described connections, are possible. So, for example, may a finishing profile have a separable nose portion 11 at one edge, whereas at the other edge no nose portion is present, but a separate nose portion is made available, which, as desired, can be joined with the flange-shaped portion.

It is clear that the finishing profiles 3 of the invention also can be applied in combination with known holders.

It is noted that the holder, without leaving the scope of the invention, may consist of a long rail or various holders of limited length dimensions, which are placed on the ground at a fixed mutual distance. Also, it is not excluded that the holders are employed together with adapters, such as those described in DE 198 54 452.

The present invention is in no way limited to the forms of embodiment described by way of example and represented in the figures, however, such finishing sets, holders and finishing profiles can be realized according to various variants without leaving the scope of the invention. As such, amongst others, it is clear that all characteristics mentioned with reference to all aspects of the invention can be mutually combined at choice, as far as they are not contradictory.

The invention claimed is:

1. A finishing profile for a floor covering, comprising:

a body having first and second portions separate from one another and functionally combinable;

wherein in a combined condition, a transition is located between the first and second portions, and a layer shaped covering extends over the two portions, the layer shaped covering connecting and maintaining the at least two portions to one another;

wherein in a separated condition such that the layer shaped covering is removed at a location generally corresponding to the transition, the first and second portions are loosened relative to one another;

wherein the layered shaped covering is selected from the group consisting of laminate, foil and veneer;

wherein the layered shaped covering is laminated to the first and second portions.

2. A finishing profile for a floor covering, comprising:

a body having first and second portions separate from one another and functionally combinable;

wherein in a combined condition, the first and second portions being directly adjacent to one another, a transition is located between the first and second portions, and a layer shaped covering extends over the two portions, the layer shaped covering connecting and maintaining the at least two portions to one another;

wherein in a separated condition such that the layer shaped covering is removed at a location generally corresponding to the transition, the first and second portions are loosened relative to one another;

wherein the layered shaped covering is selected from the group consisting of laminate, foil and veneer;

wherein the layered shaped covering is laminated to the first and second portions.

3. The finishing profile according to claim 1, wherein the first and second portions, in the combined condition, are connected exclusively by means of the layer-shaped covering, and a remaining weakened material portion located directly underneath the layer-shaped covering.

4. The finishing profile according to claim 1, wherein the first and second portions, in the combined condition, are connected solely by means of the layer-shaped covering.

5. The finishing profile according to claim 1, wherein the first and second portions, in the combined condition, adjoin directly to each other.

6. The finishing profile according to claim 1, wherein the first and second portions, in the combined condition, are additionally attached to each other by means of a locking device.

7. The finishing profile according to claim 6, wherein the locking device comprises one of a snap connection and a releasable adhesive connection.

8. The finishing profile according to claim 1, wherein the first and second portions comprise, at least partially, either a wood or of a wood-based material.

9. The finishing profile according to claim 3, wherein the first and second portions are separable and combinable, in that at least the layer-shaped covering and the remaining weakened material portion are separable at the weakened portion, and in that at least one of the first and second portions is detachable from the layer-shaped covering adjoining it.

10. The finishing profile according to claim 1, wherein at least one of the first and second portion comprise a flange-shaped portion with an attachment portion located at the lower side, and at least one nose portion located, in the combined condition, substantially underneath the flange-shaped portion.

11. The finishing profile according to claim 2, wherein the first and second portions, in the combined condition, are connected exclusively by means of the layer-shaped covering, and a remaining weakened material portion located directly underneath the layer-shaped covering.

12. The finishing profile according to claim 2, wherein the first and second portions, in the combined condition, are connected solely by means of the layer-shaped covering.

13. The finishing profile according to claim 2, wherein the first and second portions, in the combined condition, are additionally attached to each other by means of a locking device.

14. The finishing profile according to claim 13, wherein the locking device comprises one of a snap connection and a releasable adhesive connection.

15. The finishing profile according to claim 1, wherein the first and second portions comprise, at least partially, either a wood or of a wood-based material.

16. The finishing profile according to claim 11, wherein the first and second portions are separable and combinable, in that at least the layer-shaped covering and the remaining weakened material portion are separable at the weakened portion, and in that at least one of the first and second portions is detachable from the layer-shaped covering adjoining it.

17. The finishing profile according to claim 2, wherein at least one of the first and second portions comprises a flange-shaped portion with an attachment portion located at the lower side, and at least one nose portion located, in the combined condition, substantially underneath the flange-shaped portion.

* * * * *